US011305443B2

(12) United States Patent
Hogg

(10) Patent No.: US 11,305,443 B2
(45) Date of Patent: Apr. 19, 2022

(54) UTILITY INSTRUMENT AND A METHOD OF USING SAME

(71) Applicant: Jeff Hogg, Calgary (CA)

(72) Inventor: Jeff Hogg, Calgary (CA)

(73) Assignee: Jeff Hogg, Calgary (CA)

( * ) Notice: Subject to any disclaimer, the term of this patent is extended or adjusted under 35 U.S.C. 154(b) by 0 days.

(21) Appl. No.: 17/098,351

(22) Filed: Nov. 14, 2020

(65) Prior Publication Data

US 2021/0060806 A1 Mar. 4, 2021

Related U.S. Application Data

(63) Continuation of application No. 15/600,613, filed on May 19, 2017, now Pat. No. 10,870,213.

(60) Provisional application No. 62/339,474, filed on May 20, 2016.

(51) Int. Cl.

| | |
|---|---|
| ***B26B 27/00*** | (2006.01) |
| ***B26B 1/08*** | (2006.01) |
| ***B26B 5/00*** | (2006.01) |
| ***B26B 9/02*** | (2006.01) |

(52) U.S. Cl.

CPC ..... *B26B 27/007* (2013.01); *B26B 1/08* (2013.01); *B26B 5/003* (2013.01); *B26B 5/001* (2013.01); *B26B 9/02* (2013.01)

(58) Field of Classification Search

CPC ..... B26B 27/00; B26B 27/002; B26B 27/005; B26B 27/007; B26B 21/527

USPC ..... 30/162, 163, 291, 295, 298

See application file for complete search history.

(56) References Cited

U.S. PATENT DOCUMENTS

| | | | | | |
|---|---|---|---|---|---|
| 651,796 | A * | 6/1900 | Crandall | B26B 27/007 | 30/291 |
| 668,724 | A * | 2/1901 | Wiesedeppe | B26B 27/007 | 30/291 |
| 687,930 | A * | 12/1901 | Wiesedeppe | B26B 27/007 | 30/291 |
| 814,080 | A * | 3/1906 | Reed | B26B 27/007 | 30/298 |
| 1,190,052 | A * | 7/1916 | Welander | B26B 27/007 | 30/298 |
| 1,300,521 | A * | 4/1919 | Villiger | B26B 27/007 | 30/291 |
| 1,365,952 | A * | 1/1921 | Raymer | B26B 27/007 | 30/161 |
| 1,497,077 | A * | 6/1924 | Freeman | B26B 27/007 | 30/291 |
| 1,536,752 | A * | 5/1925 | Beatty | B26B 27/00 | 30/291 |

(Continued)

*Primary Examiner* — Kenneth E Peterson
*Assistant Examiner* — Richard D Crosby, Jr.
(74) *Attorney, Agent, or Firm* — Gowling WLG (Canada) LLP

(57) ABSTRACT

A utility instrument is in the form of a cutting tool suitable for fitting onto a user's finger. The tool has a blade and a sheath, both coupled to a mounting structure. The blade and sheath are pivotable with respect to each other. A user can wear the tool on a finger about a finger joint. The user can bend the finger to set the tool to an open condition to expose the blade for use, and can stretching the finger to set the tool to a closed condition to safely shade the blade using the sheath. The tool may further have a housing for fully receiving the blade. The blade may extend out of the housing for use, and may be retracted into the housing for safety.

3 Claims, 24 Drawing Sheets

(56) References Cited

U.S. PATENT DOCUMENTS 1,547,863 A * 7/1925 Dulin ..... B25B 27/08 29/270
1,643,336 A * 9/1927 Frost ..... A47L 17/06 30/169
2,811,969 A * 11/1957 Shubert ..... A61B 17/4208 606/125
2,989,807 A * 6/1961 Florence ..... B26B 11/00 30/151
3,126,890 A * 3/1964 Deming, Sr. ..... A61B 17/4208 2/161.7
D208,045 S * 7/1967 Torongo, Jr. et al. ..... D8/3
3,587,591 A * 6/1971 Satterwhite ..... A61B 17/4208 606/125
3,593,803 A * 7/1971 Ibach ..... A01B 1/00 172/10
3,687,139 A * 8/1972 Poirier ..... A61B 17/4208 606/125
3,735,760 A * 5/1973 Vreeland, Jr. ..... A61M 31/00 604/212
4,087,911 A * 5/1978 Schrock ..... B26B 3/00 30/153
4,149,601 A * 4/1979 Taylor ..... A41D 19/01594 172/370
4,330,894 A * 5/1982 Hayden ..... B67B 7/24 7/152
4,339,878 A * 7/1982 Tozzi ..... B26B 27/007 30/291
4,357,945 A * 11/1982 Janko ..... G01N 31/22 600/584
4,797,974 A * 1/1989 Smith, Jr. ..... A22C 25/06 294/25
4,867,246 A * 9/1989 Kiger ..... A01B 1/00 172/370
4,976,032 A * 12/1990 Battaglia ..... A01D 46/247 30/298
5,036,589 A * 8/1991 Heinrich ..... B26B 27/007 30/298
5,038,479 A * 8/1991 Davis ..... B26B 27/007 30/298
5,058,278 A * 10/1991 Colvin ..... F41B 15/00 30/298
5,325,596 A * 7/1994 Baker ..... B26B 27/007 2/163
5,357,680 A * 10/1994 Monistere ..... B26B 21/525 30/298
5,628,069 A * 5/1997 Ebert ..... A41D 19/01547 2/161.1
6,122,828 A * 9/2000 Asterino, Jr. ..... B26B 3/06 30/151
6,298,489 B1 * 10/2001 Cox ..... A41D 19/01594 2/160
6,896,681 B1 * 5/2005 Watson ..... A61B 42/10 606/125
D720,197 S * 12/2014 Oldham ..... D8/98
9,155,425 B2 * 10/2015 Lemasters ..... A47J 43/26
10,118,306 B2 * 11/2018 Scimone ..... B26B 27/007
D839,709 S * 2/2019 Halvorson ..... D8/99
2005/0193565 A1 * 9/2005 Knowles ..... B26B 27/007 30/155
2006/0248729 A1 * 11/2006 Shivas ..... B65H 35/002 30/165
2008/0066321 A1 * 3/2008 Vallero ..... A61B 17/0467 30/298
2010/0236077 A1 * 9/2010 Shirey ..... B26B 27/007 30/152
2010/0251552 A1 * 10/2010 Gazcon ..... B26B 1/08 30/162
2011/0113631 A1 * 5/2011 Zdunek ..... B26B 21/00 30/34.05
2012/0304471 A1 * 12/2012 Jones ..... B26B 5/001 30/162
2014/0259694 A1 * 9/2014 Oldham ..... B26B 27/007 30/298
2015/0183120 A1 * 7/2015 Jones ..... B26B 5/001 30/162
2015/0328791 A1 * 11/2015 Jones ..... B26B 3/08 30/162
2016/0286910 A1 * 10/2016 Fisher ..... F41B 13/00
2016/0311123 A1 * 10/2016 Schoon ..... B26B 5/00
2017/0115092 A1 * 4/2017 Holmes, Sr. ..... F41B 15/00

* cited by examiner

Full length finger sock/sleeve with fold over extensions;
3 sizes of sleeves S/M/L or one size fitting all Thin stretchy material (e.g., neoprene or spandex)
- Slight grip on inside of the sleeve to prevent sliding Thin rubber padding underneath sleeve
to provide stability and strength

UTILITY INSTRUMENT AND A METHOD OF USING SAME

CROSS-REFERENCE TO RELATED APPLICATIONS

This application is a continuation of U.S. patent application Ser. No. 15/600,613, filed on May 19, 2017, which claims the benefit of U.S. Provisional Patent Application Ser. No. 62/339,474, filed on May 20, 2016, the content of each of which is incorporated herein by reference in its entirety.

FIELD OF THE DISCLOSURE

The present invention relates generally to a utility instrument, and in particular to a hand-tool for attaching to an appendage such as a finger or an arm about a joint thereof, and being utilized by bending the appendage.

BACKGROUND

Hand tools such as knives are known. Generally, a knife comprises a handle for holding and a blade for cutting. The handle may also act as a sheath for protecting the blade and for preventing accidental injury to the user. For example, retractable knives comprise a handle accessible to a retractable blade. The knives may be closed by retracting the blade into the handle, and open by extending the blade therefrom. In foldable knives, the handle comprises a longitudinal groove, and is rotatably coupled to the blade by a pivot. The knives may be closed by rotating the blade into the longitudinal groove, and open by rotating the blade out of the longitudinal groove.

A drawback of opening and closing known knives is that their use requires manual manipulation of the related closure mechanisms. For example, foldable knives generally require the use of two hands to open and close. While retractable knives generally only require one-hand operations, opening and closing actions still require holding the knife with a hand and use of a finger such as the thumb, to extend or retract the blade. Therefore, a user has to remove any content held in one or two hands before opening or closing the knife, thereby causing inconvenience of use and delays to work.

Another drawback of known knives is that, from time to time, a user has to remove a knife from their hand in order to do other tasks. Additionally, the user may forget where they've left the knife and subsequently need to search for it, thereby causing inconvenience of use and delays to work. Moreover, a user may accidentally drop the knife, and the dropping knife may cause injury to nearby people and/or causing damage to nearby objects.

SUMMARY

Herein, a utility instrument or apparatus is disclosed. In one embodiment, the utility instrument is in the form of a finger-fitting box and package opener or cutting tool. The cutting tool fits onto a user's finger, preferably a middle finger, of either hand via a finger attachment structure having a finger sleeve and/or one or more straps. A utility component in the form of a blade such as a serrated plastic, metal, or steel blade, and a sheath thereunder are coupled to the finger sleeve or one or more straps. The blade and sheath are pivotably coupled to each other with a hinge or pivoting component. The sheath protects the finger thereunder from the blade thereabove.

In use, the cutting tool can be easily attached to the user's finger about a finger joint or knuckle. Therefore, the user does not need to hold the tool in hand. In some embodiments, the user can bend the finger to set the tool to an open condition and expose the blade. The user can then move the finger, hand, wrist, and/or the arm to cut taped boxes. By using the cutting tool disclosed herein, the user can benefit from safer and more ergonomically correct opening of packages compared to the use of known knives. The stability and force of the knuckle combined with arm strength allow easy opening of a variety of packages and other suitable uses. In addition, users can conduct their work more efficiently by using the tool disclosed herein, to enable continuous and uninterrupted workflow with their hands.

In these embodiments, the user can stretch their finger to set the tool to a closed condition to safely shade the blade using the sheath, allowing the user to perform everyday duties such as unloading and moving packages, answering the phone, typing, writing, and the like that do not need to use the cutting tool, while still wearing the cutting tool.

In some embodiments, the tool may further comprise a housing for fully receive the blade therein when the tool is in a retracted condition. The user may move an actuation member on the housing to extend the blade out of the housing. The user can then bend the finger to set the tool to the open condition and expose the blade, or stretch the finger to set the tool to the closed condition to safely shade the blade using the sheath. Moreover, when the blade is out of the housing (i.e., the tool is in either the open condition or the closed condition), the user may push a release button to retract the blade into the housing and reset the tool to the retracted condition.

In some embodiments, the apparatus disclosed herein may alternatively comprise other suitable utility components. For example, in one embodiment, the utility component may be a hook which may be exposed in the open condition and shaded by the sheath in the closed condition. In another embodiment, the utility component may be a flashlight which may be turned on in the open condition and turned off in the closed condition. In both examples, a user can set the tool to the open condition by bending the finger, and set the tool to the closed condition by stretching the finger.

According to one aspect of this disclosure, there is provided an apparatus. The apparatus comprises: a mounting structure removably attachable onto an appendage about a joint thereof, the mounting structure comprising a first portion and a second portion pivotable about the joint; a utility component coupled to a first portion of the mounting structure; and a protection component coupled to a second portion of the mounting structure. The apparatus is in a closed condition when the first and second portions are at a first angle. The apparatus is in an open condition when the first and second portions are at a second angle larger than the first angle.

In some embodiments, the appendage is a finger.

In some embodiments, the utility component comprises a blade.

In some embodiments, the blade is made of steel, hard plastic or hard polymer.

In some embodiments, the apparatus further comprises a housing. The blade is extendable out of the housing and retractable thereinto. The apparatus is in the closed condition when the blade extends out of the housing and the first and second portions are at a first angle. The apparatus is in the open condition when the blade extends out of the housing and the first and second portions are at a second angle larger than the first angle. The apparatus is in a retracted condition when the blade is retracted into the housing.

In some embodiments, the first angle is smaller than 30° and the second angle is larger than 60°.

In some embodiments, the first angle is 0° and the second angle is 90°.

In some embodiments, the mounting structure comprises a flexible band coupling to the protection component and the housing.

In some embodiments, the mounting structure further comprises one or more straps coupled at least to the flexible band.

In some embodiments, the mounting structure further comprises one or more straps coupled at least to the housing.

In some embodiments, the mounting structure further comprises a first strap coupled to the protection component and a second strap coupled to the utility component.

In some embodiments, the mounting structure is a flexible sleeve.

In some embodiments, the sleeve is made of fabric.

In some embodiments, the sleeve comprises at least one pull tab.

In some embodiments, the utility component comprises a hook.

In some embodiments, the utility component comprises a flashlight.

According to one aspect of this disclosure, there is provided a method of cutting an object. The method comprises attaching a protection component onto a finger of a hand about a knuckle at a distal side of the finger; attaching a blade onto the finger about the knuckle at a proximal side thereof; bending the finger about the knuckle to rotate the protection component away from the blade; and moving the hand to cut the object using the blade.

In some embodiments, the method further comprises straightening the finger about the knuckle to rotate the protection component towards the blade for shading the blade.

In some embodiments, the step of attaching a blade onto the finger comprises movably receiving the blade in a housing; and attaching the housing onto the finger about the knuckle at the proximal side thereof.

In some embodiments, the method further comprises extending the blade out of the housing.

In some embodiments, the method further comprises retracting the blade into the housing.

DETAILED DESCRIPTION

Figure 1A:
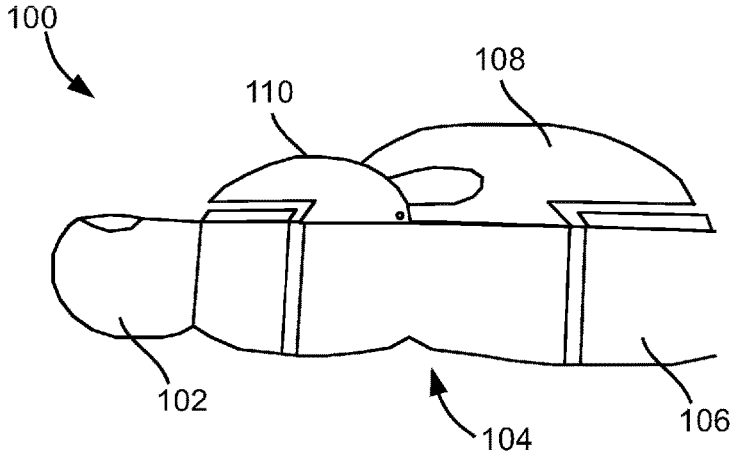
FIGS. 1A to 1C illustrates a utility instrument in the form of a cutting tool according to some embodiments of this disclosure, wherein the cutting tool is in a closed condition.
Figure 1B:
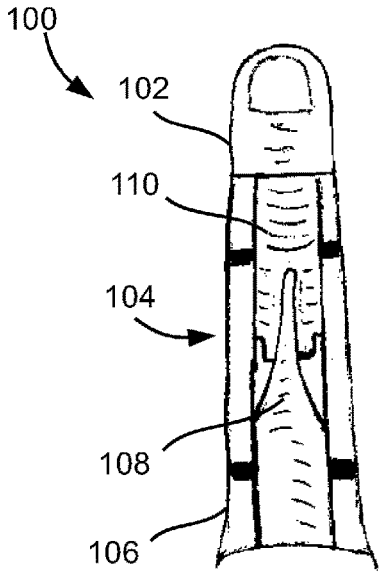
Figure 1C:
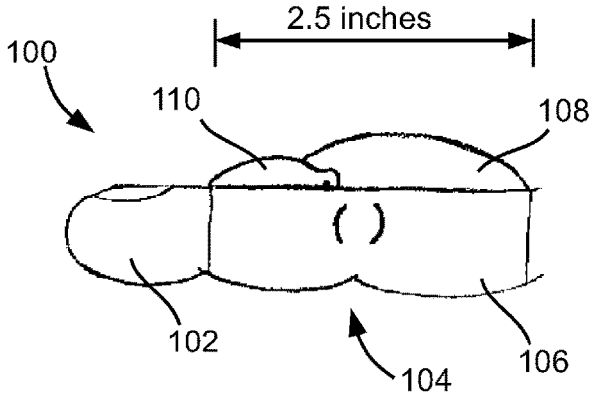

Turning to FIGS. 1A to 1C, a utility instrument in a closed condition is shown and is generally referred using numeral 100. In this embodiment, the utility instrument is a cutting tool. The tool 100 comprises a mounting structure 106 for removably mounting or attaching the tool 100 onto an appendage 102 such as a finger or a limb about a joint or knuckle 104 thereof. For example, the tool 100 may be mounted to the middle finger of a user's hand about the middle knuckle thereof. The tool 100 also comprises a utility component 108 in the form of a blade and a protection component 110 in the form of a sheath, both coupled to the mounting structure 106.

A user may attach the tool 100 to a finger 102 about the knuckle 104 such that the protection component 110 is positioned on the back of the hand at a distal side of the knuckle 104, and the utility component 108 is positioned on the back of the hand at a proximal side thereof. Herein, the "proximal side" of a knuckle 104 refers to the side of the knuckle close to the palm, and the "distal side" of a knuckle refers to the side of the finger close to the fingertip.

After attaching the tool 100 to the finger 102 about the joint 104, a user may turn the tool 100 into the closed condition by stretching the finger 102 such that the sheath 110 shades at least a portion of the blade 110 for protecting the blade 108 and for preventing accidental injury to the user. In the closed condition, the total length of the blade 108 and the sheath 110 may be about 2.5 inches.

Figure 2:
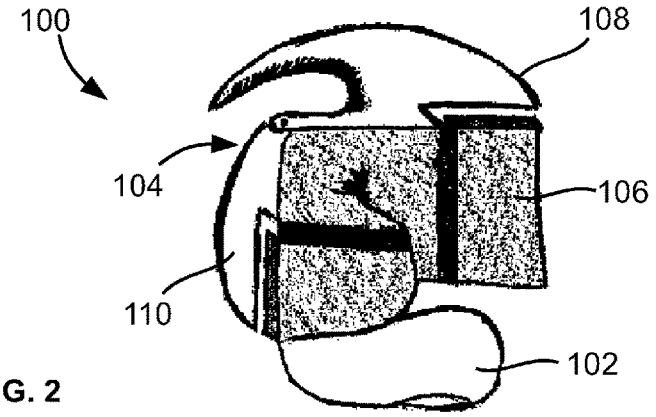
FIG. 2 illustrates the cutting tool shown in FIG. 1A in an open condition.

FIG. 2 shows the tool 100 in an open condition. As shown, the user may bend the finger 102 to rotate the sheath 110 away from the blade 108 to expose the blade for use such as cutting taped boxes, sealed plastic bags and the like.

Figure 3A:
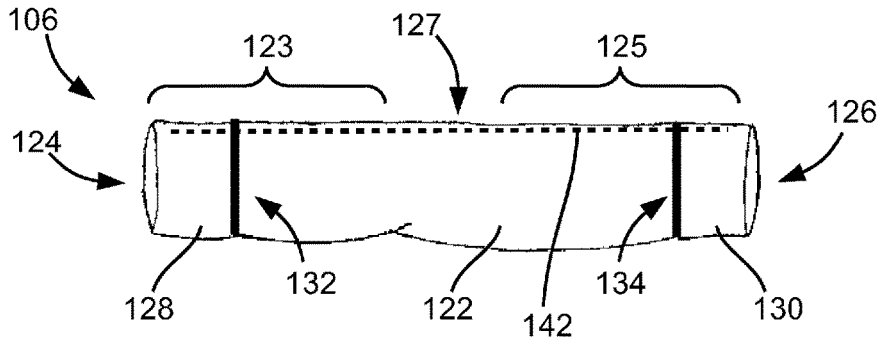
FIGS. 3A and 3B show a mounting structure of the tool of FIG. 1A.
Figure 3B:
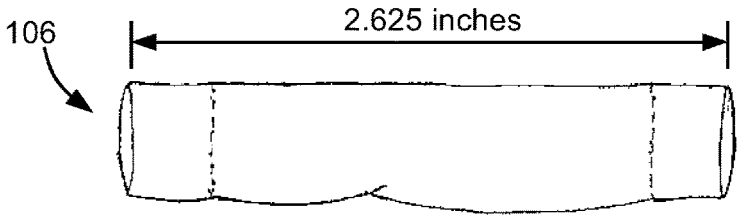

As shown in FIGS. 3A and 3B, the mounting structure 106 in this embodiment comprises a wearable sleeve or sock 122 reinforced by a reinforcement padding 142. The sleeve 122 is made of suitable material, e.g., rubber such as neoprene, synthetic fiber such as spandex, other fabric, cloth, or the like. Preferably, the inner surface of the sleeve is slightly gripping to prevent the sleeve 122 from sliding on the finger 102.

The sleeve 122 is properly sized to provide snug fit with comfortable and adequate tightness. In some embodiments, the sleeve 122 may have a plurality of sizes, e.g., small (S), medium (M) and large (L), for fitting onto different finger sizes. Alternatively, when the sleeve 122 is made of stretchy material with suitable stretchiness, the sleeve 122 may have a single size for fitting onto all finger sizes.

In this embodiment, the sleeve 122 has a length suitable for extending from about a proximal side of the first knuckle closest to fingertip, to about the end of the finger before the last knuckle. As shown in FIG. 3B, the sleeve 122 in this embodiment has a length of about 2 and ⅝ inches (2.625 inches).

As shown in FIG. 3A, the sleeve 122 and thus the mounting structure 106, comprises a first portion 123 and a second portion 125 pivotable about a pivot point 127. As will be shown later, the sheath 110 and the blade 108 are coupled to the first and second portions 123 and 125, respectively. When the tool 100 is slipped onto a finger about a joint thereof, the pivot point 127 is located about the joint of the finger.

Referring again to FIGS. 1A to 1C, when the finger 102 is stretched to turn the tool 100 to the closed condition, the first and second portions 123 and 125 of the mounting structure 106 are generally at a first, small angle such as an angle smaller than 30°, or are in parallel (i.e., at about 0°). Referring to FIG. 2, when the finger 102 is bent to turn the tool 100 to the open condition, the first and second portions 123 and 125 of the mounting structure 106 are at a second, large angle such as an angle larger than 60°. In the example of FIG. 2, the first and second portions 123 and 125 of the mounting structure 106 are at about 90° and the tool 100 is in the open condition. In some alternative embodiments, the first, small angle may be an angle smaller than 45°, and the second, large angle may be an angle larger than 45°.

Referring back to FIG. 3A, the sleeve 122 further comprises fold-overs or pockets 128 and 130 on the opposite ends 124 and 126 of the first and second portions 123 and 125, respectively. The pockets 128 and 130 comprise respective openings 132 and 134 facing the center of the sleeve 122, for coupling the sheath 110 and blade 108 to the sleeve 122, respectively. The pockets 128 and 130 provide sufficient grip for securing the sheath 110 and blade 108 thereto. For example, the pockets 128 and 130 may be made of stretchy material to provide required grip via stretching, may comprise high-friction surface(s) to provide required grip via friction, or may alternatively use strings or elastics to tie the sheath 110 and blade 108 to the finger 102 wearing the sleeve 122.

Figure 4A:
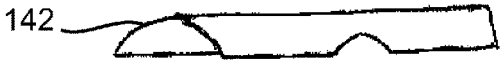
FIGS. 4A to 4C show a reinforcement padding of the mounting structure of FIG. 3A.
Figure 4B:
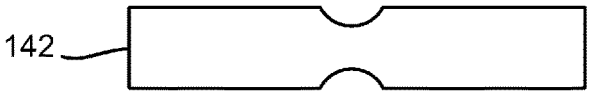
Figure 4C:
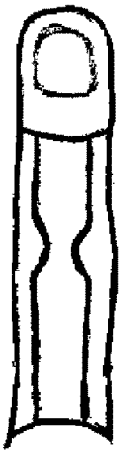
Figure 5A:
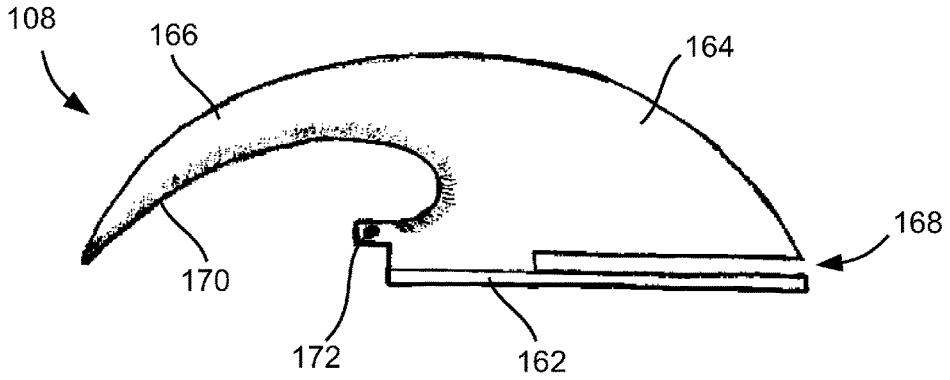
FIGS. 5A to 5D show a blade of the tool of FIG. 1A.
Figure 5B:
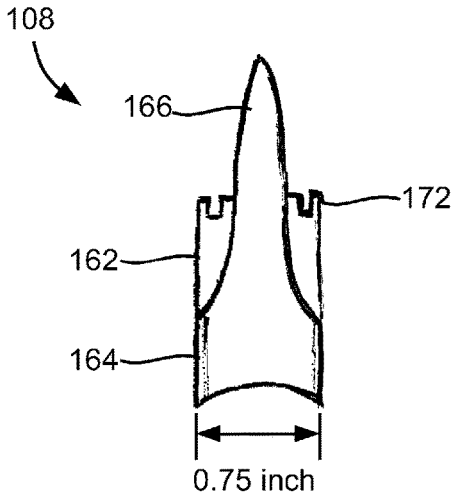
Figure 5C:
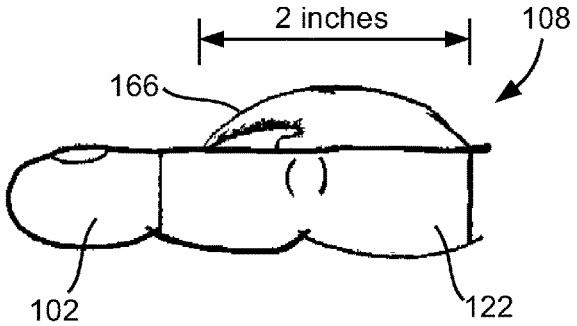
Figure 5D:
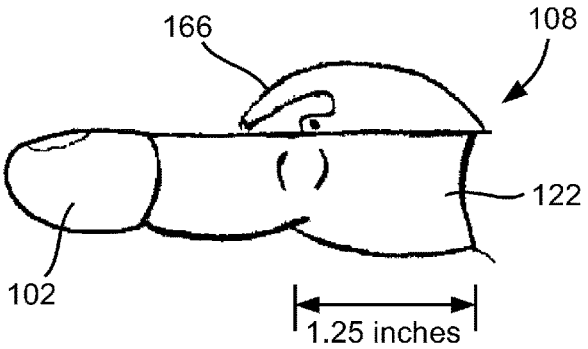

As shown in FIGS. 4A and 4B, the padding 142 is a laterally slightly curved thin plate extending along a longitudinal direction. The padding 142 is made of a material such as rubber or foam with suitable solidity for protecting the finger 102 from the sharp edge of the blade and with suitable flexibility to adapt to the bending and stretching of the finger 102. Moreover, the length, width, and lateral curvature of the padding 142 are selected to fit the sleeve 122 and finger 102, and provide additional comfort and overall strength.

FIGS. 5A to 5D illustrate the blade 108. As shown, the blade 108 comprises a base 162 slightly laterally curved and a body 164 extending to a tip portion 166. The base 162 and body 164 form and are partially separated by a rear facing gap 168 therebetween for inserting the base 162 into the front-facing pocket 134 and coupling the blade 108 to the sleeve 122.

In this embodiment, the tip portion 166 of the blade 108 is arched towards the base 162 and comprises a serrated sharp cutting edge 170 facing the base 162. The base 162 also comprises a female hinge 172 for pivotably coupling to a male hinge of the sheath 110 (described later).

In this embodiment, the blade 108 is made of suitable hard material such as steel, hard plastic, hard polymer (for example ABS), or the like, and may be manufactured using molding or any other suitable methods. The width of the blade 108 is about ¾ inch (0.75 inch), the total length of the blade 108 is about 2 inches, and the length of the base 162 is about 1 and ¼ inches (1.25 inches).

Figure 6A:
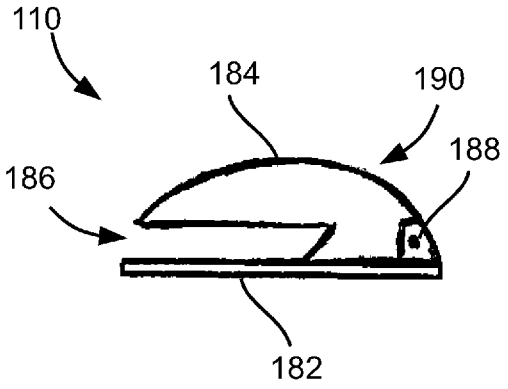
FIGS. 6A to 6C show a sheath of the tool of FIG. 1A.
Figure 6B:
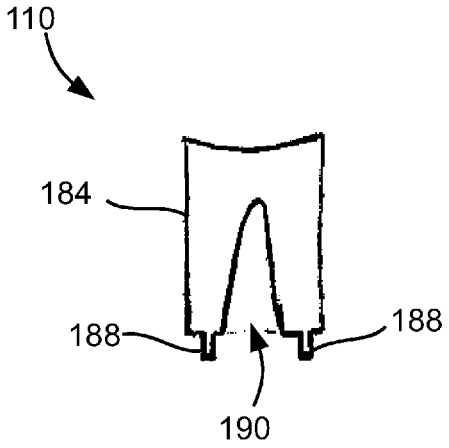
Figure 6C:
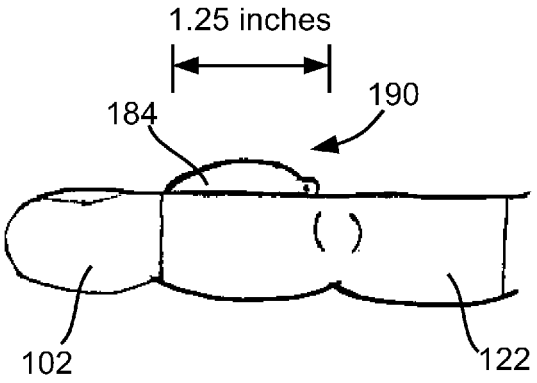

FIGS. 6A to 6C illustrate the sheath 110. As shown, the sheath 110 comprises a body 184 and a laterally slightly curved base 182. The base 182 and body 184 form and are partially separated by a front-facing gap 186 therebetween for inserting the sheath 110 into the rear-facing pocket 132 and coupling the sheath 110 to the sleeve 122.

In this embodiment, the body 184 comprises a rear-facing cut-out or recess 190 for receiving and housing the tip portion 166 of the blade 108 when the tool 100 is in the closed condition. The base 182 comprises a male hinge 188 for pivotably coupling to the female hinge 172 of the blade 108.

In this embodiment, the sheath 110 is made of suitable hard material such as steel, hard plastic, hard polymer (for example ABS), or the like, and may be manufactured using molding or any other suitable methods. The width of the sheath 110 is about ¾ inch (0.75 inch), and the total length of the sheath 110 is about 1 and ¼ inches (1.25 inches).

Figure 7:
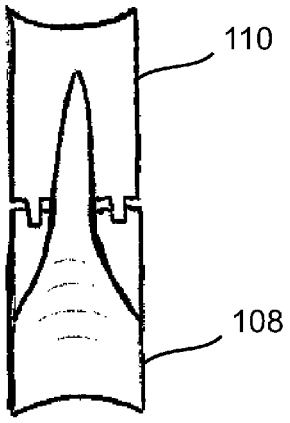
FIG. 7 shows an assembled combination of the blade of FIG. 5A and the sheath of FIG. 6A.

FIG. 7 shows the blade 108 and sheath 110 in an assembled state, pivotably coupled together by coupling the female and male hinges 172 and 188 using a plastic rivet or the like.

The assembled combination of the blade 108 and sheath 110 is then secured to the mounting structure 106 by inserting the base 182 of the sheath 110 and the base 162 of the blade 108 into pockets 132 and 134 of the sleeve 122, respectively, and is secured therein using suitable fastening components such as rivets, screws, glue/adhesive, nails, or the like.

In some alternative embodiments, the hinge 172 of the blade 108 may be a male hinge and the hinge 188 of the sheath 110 may be a female hinge.

Figure 8A:
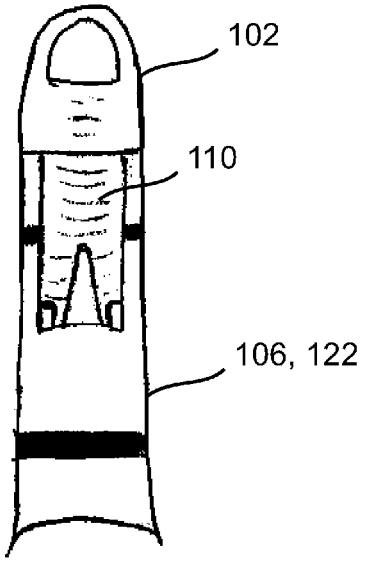
FIGS. 8A and 8B show the sheath of FIG. 6A attached to the mounting structure of FIG. 3A during assembling, according to an alternative embodiment.
Figure 8B:
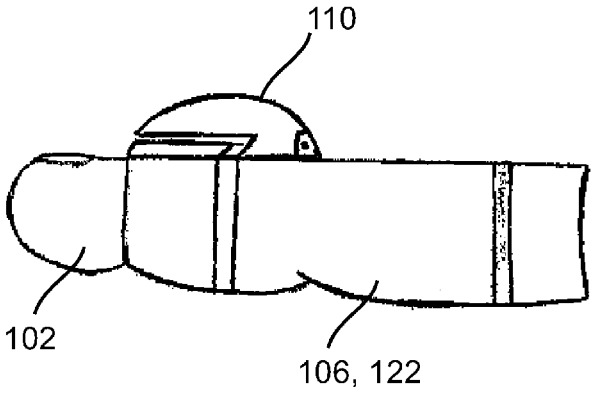

In some alternative embodiments, the hinges 172 and 188 may be pivotably coupled by snapping them together. In these embodiments, one may separately attach the sheath 110 and the blade 108 to the mounting structure 106 by inserting them into the pockets 132 and 134 of sleeve 122, respectively, and then snap the hinges 172 and 188 together. FIGS. 8A and 8B show the sheath 110 attached to the mounting structure 106.

Figure 9A:
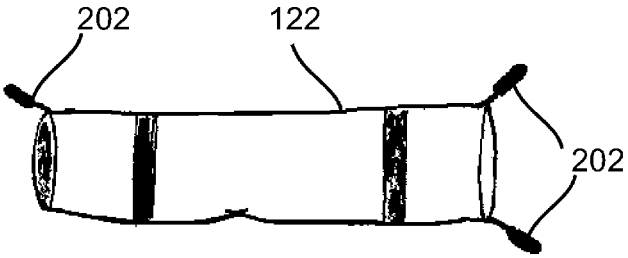
FIGS. 9A and 9B show a sleeve of the tool of FIG. 1A, according to another embodiment.
Figure 9B:
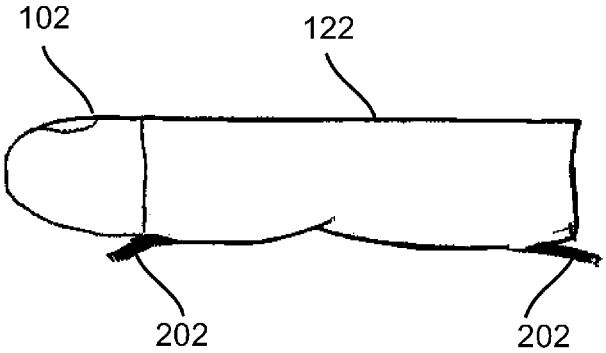

In another embodiment as shown in FIGS. 9A and 9B, the sleeve 122 may comprise one or more pull tabs 202 for pulling the sleeve 122 onto the finger 102, or off therefrom.

Figure 10:
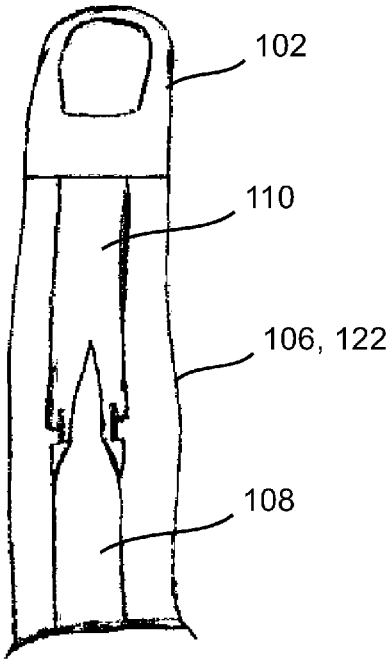
FIG. 10 shows a utility instrument in a closed condition, according to another embodiment.

In some alternative embodiments as shown in FIG. 10, the sleeve 122 does not comprise any pockets. The blade and sheath 108 and 110 are secured to the sleeve 122 using suitable fasteners such as rivets, screws, glue/adhesive, nails, stitching, or the like.

Figure 11:
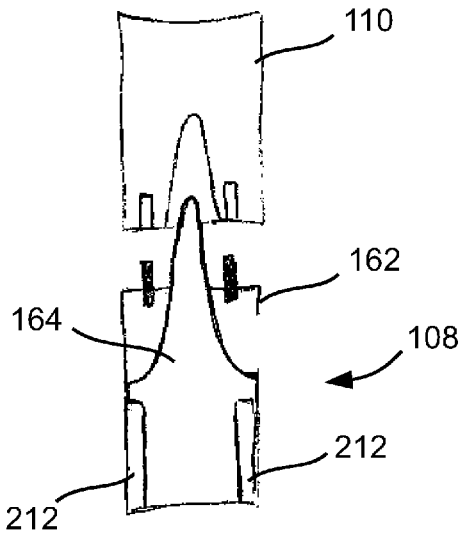
FIG. 11 shows a blade and a sheath of a utility instrument, according to another embodiment.

In some alternative embodiments as shown in FIG. 11, the blade 108 comprises a base 162 and a replaceable blade body 164. As shown, the base 162 comprises a pair of tabs 212 for snapping into the replaceable blade body 164.

Figure 12:
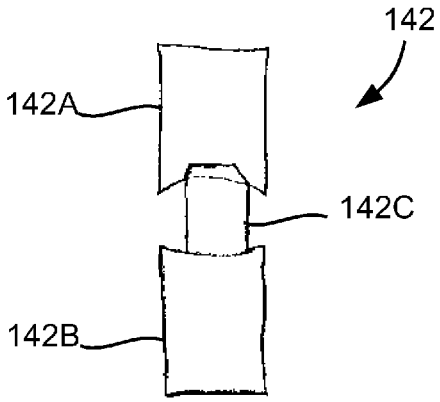
FIG. 12 shows a reinforcement padding of a utility instrument, according to another embodiment.

In some alternative embodiments, the padding 142 may comprise two separate pieces. In some other embodiments as shown in FIG. 12, the padding 142 may comprise two separate pieces 142A and 142B connected by a spring plate 142C. In yet some other embodiments, the two pieces 142A and 142B may each comprise an opening for receiving the spring plate 142C.

Figure 13:
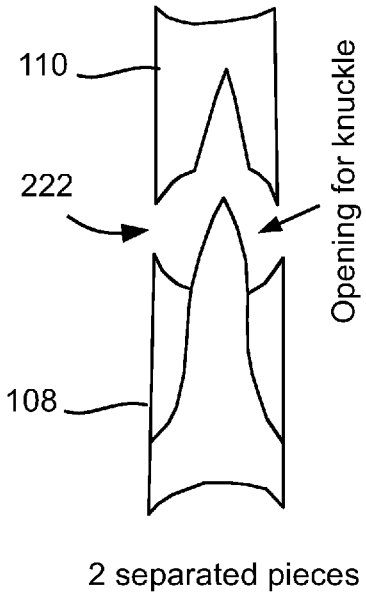
FIG. 13 shows a blade and a sheath of a utility instrument, according to another embodiment.
Figure 14A:
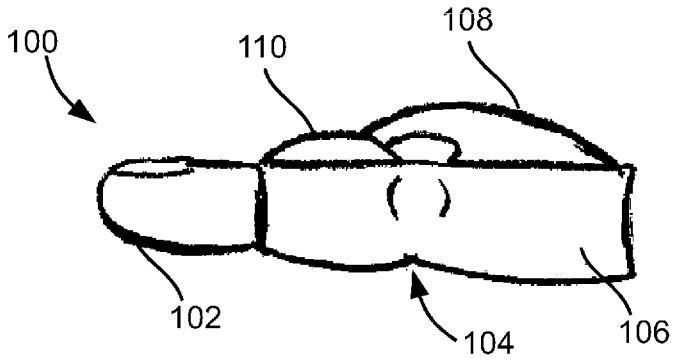
FIGS. 14A and 14B show the utility instrument of FIG. 13 in a closed condition (finger stretched) and in an open condition (finger bent), respectively, according to another embodiment.
Figure 14B:
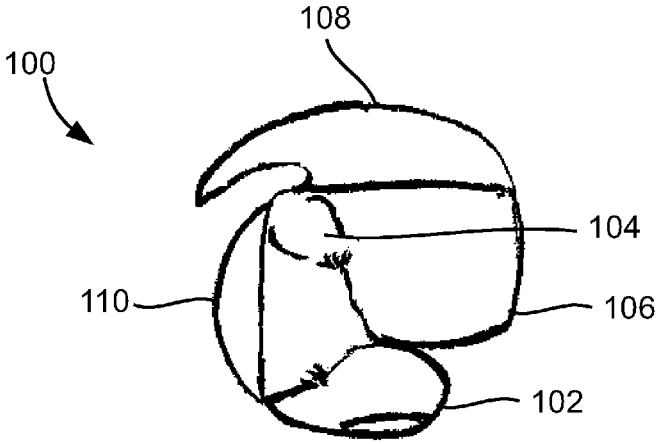

In some alternative embodiments as shown in FIG. 13, the blade 108 and sheath 110 do not comprise hinges. In this embodiment, the blade 108 and sheath 110 are separately secured to the sleeve 122 and are coupled to each other therethrough. As shown in FIG. 13, when securing the blade 108 and sheath 110 to the sleeve 122, a distance 222 is preferably maintained therebetween for adapting to the knuckle or joint of the finger. FIGS. 14A and 14B show the tool 100 in the closed condition (finger stretched) and in the open condition (finger bent), respectively.

Figure 15:
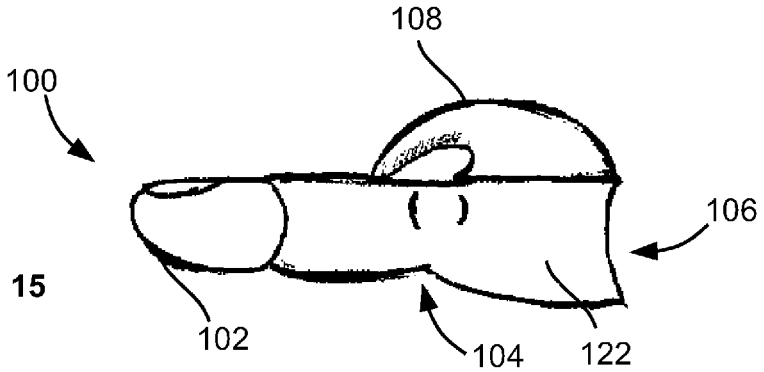
FIG. 15 show a utility instrument in a closed condition, according to another embodiment.

In some alternative embodiments as shown in FIG. 15, the tool 100 does not comprise any sheath. In this embodiment, the mounting structure 106, including the sleeve 122 and padding 142 shades the blade 108 in the closed condition and provides the required protection.

In some alternative embodiments, the padding 142 may be mounted on top of the sleeve 122.

Those skilled in the art appreciate that the sizes described above are examples only. Other suitable sizes may alternatively be used depending on the implementation and design choices.

The above described cutting tool 100 comprises an arched blade 108 suitable for cutting and opening tape-sealed boxes, plastic bags, paper bags, shrink wrap, and the like. In an alternative embodiment, the cutting tool 100 comprises a more arched, semi-circular serrated blade for cutting twine, rope, and the like. In another embodiment, the tool 100 comprises a blade having a straight tip portion.

Those skilled in the art appreciate that the cutting tool described above is only an example of the utility instrument disclosed herein. In some other embodiments, rather than having a blade as the utility component 108, the tool 100 may alternatively comprise other suitable utility components. For example, in one embodiment, the utility instrument 100 comprises a hook-shaped utility component 108 mounted to the mounting structure 106 for grabbing objects. In another embodiment, the utility instrument 100 comprises a screw driver.

In some alternative embodiments, the utility instrument 100 comprises a utility component 108 in the form of a flashlight. A switch of the flashlight is coupled to the pivot 127 such that the light is tuned off when the tool is in the closed condition (finger stretched) and is turned on when the tool is in the open condition (finger bent).

In some alternative embodiments, the utility component 108 is replaceable. In these embodiments, different types of replaceable utility components 108 are provided such that one may mount suitable utility component 108 to the tool 100 as needed.

In some alternative embodiments, the mounting structure 106 of the tool 100 may not comprise a sleeve 122 and may use other suitable means for attached the tool 100 to a finger, for example by using strings, straps, tape and/or the like.

In some other embodiments, the tool 100 may be a tool suitable for attaching to limbs such as an arm about the elbow, a leg about the knee, and the like.

In some other embodiments, the tool 100 may be attached to an artificial appendage such as an artificial finger, an arm and/or a leg of a robot.

In some other embodiments, the mounting structure comprises a flexible band with one or more straps coupled thereto. The protection component 110 and the utility component 108 are both coupled to a flexible band and maintained at a distance suitable for adapting to the knuckle. The straps are usable for tying the tool 100 to a finger.

The utility instrument 100 provides improved workplace efficiency by providing safe, continuous, and uninterrupted workflow with user's hands with advantages such as:

- a user does not need to stop working to reach for a utility knife or cutting tool;
- a user can maintain hand free and does not need to hold the tool when using the tool;
- serrated plastic blades used in the cutting tool 100 are much safer than traditional razor blades;
- the cutting tool 100 allows one to use the middle finger to comfortably cut and open packages with solid force and strength from all directions;
- the utility instrument 100 (including in the form of above described cutting tool) allows one to write, type, talk on the phone and perform other duties while wearing the tool 100;
- the utility instrument 100 is easy to use, affordable and durable;
- the utility instrument 100 may comprise a sleeve 122 with one size fitting all, and can be utilized by both right and left handed individuals;
- the utility instrument 100 provides peace of mind to the users by ensuring them that they cannot drop the tool during use;
- in the form of a cutting tool, the utility instrument 100 exploits the strength of a person's clinched middle knuckle along with arm strength;
- the utility instrument 100 is comfortable to wear; and
- the protection component 110 also provides protection to the finger during dragging along surfaces.

FIGS. 16A to 16G show a utility instrument 300 in the form of a cutting tool wearable on a finger such as a middle finger of a user, according to some embodiments of this disclosure. As shown, the cutting tool 300 comprises a housing 302 enclosing therein a blade 304 and a blade extension/retraction structure (not shown).

The housing 302 comprises a bottom wall 310, a front upper portion 312 and a rear upper portion 314. The bottom wall 310 is laterally slightly curved for substantially adapting to the shape of a finger. Moreover, the bottom wall 310 extends upwardly about a rear end 322 thereof for adapting to the raised shape of a knuckle (not shown). Herein, the "lateral", "longitudinal", "upward", "downward", "forward", and "rearward" directions are generally shown in FIGS. 16D and 16F.

The bottom wall 310 comprises a pair of anchor structures 316A and 316B on opposite sides thereof for attaching a strap 318. The strap 318 forms a portion of a mounting structure for attaching the cutting tool 300 onto a user's finger.

The front upper portion 312 forms a front portion of the housing 302 and is mounted to the bottom wall 310 via suitable fastening components such as rivets, screws, glue/adhesive, nails and/or the like. The font upper portion 312 comprises a front opening 324 on a front wall thereof for accessing the blade 304. The font upper portion 312 also comprises a pair of side openings 326A and 326B on opposite sidewalls. A pair of release buttons 328A and 328B of the blade extension/retraction structure extend outwardly from the side openings 326A and 326B, respectively, which may be pushed inwardly for retracting the blade 304 into the housing 302 (described in more detail later). Herein, "inward" or "inwardly" refers to a direction towards the inside of the housing 302.

The rear upper portion 314 forms a rear portion of the housing 302 and removably coupled to the bottom wall 310 and the front upper portion 312. The rear upper portion 314 comprises a tab 330 at a rear end thereof for removing the rear upper portion 314 from the housing 302 for accessing the interior of the housing 302 such as for replacing the blade 304.

Figure 16A:
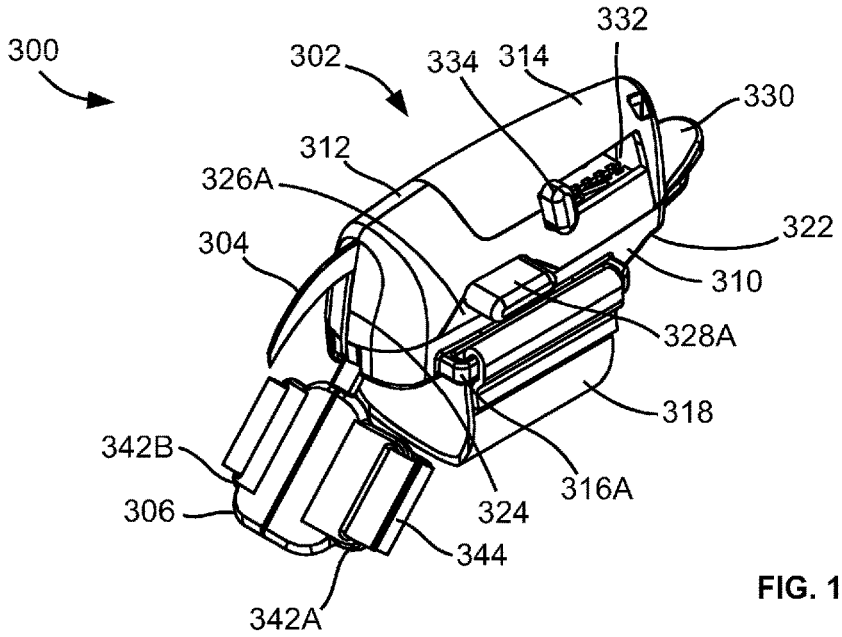
FIG. 16A is a perspective view of a utility instrument in the form of a wearable cutting tool in an open condition, according to some alternative embodiments of this disclosure.
Figure 16B:
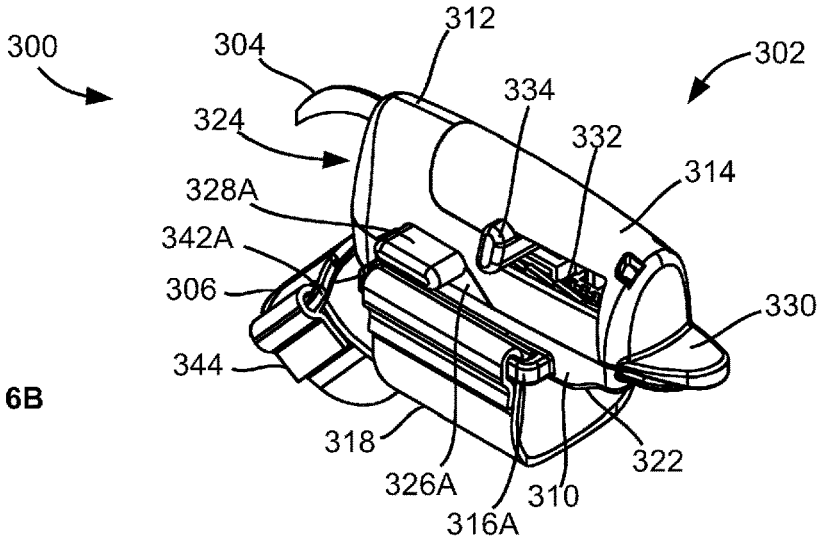
FIGS. 16B and 16C are perspective views of the cutting tool shown in FIG. 16A in the open condition, viewed from other directions.
Figure 16C:
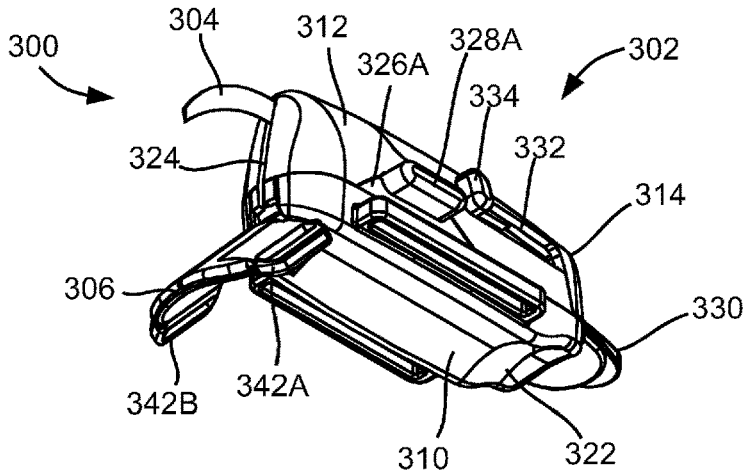
Figure 16D:
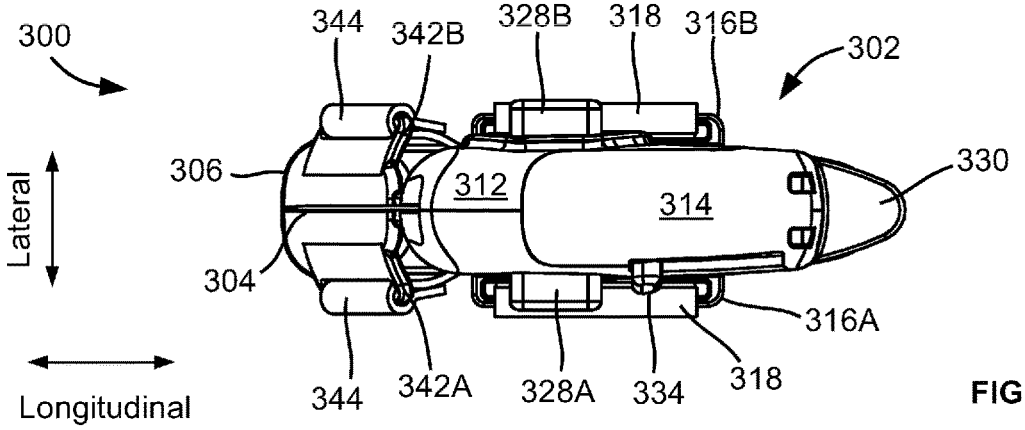
FIG. 16D is a top view of the cutting tool shown in FIG. 16A in the open condition.
Figure 16E:
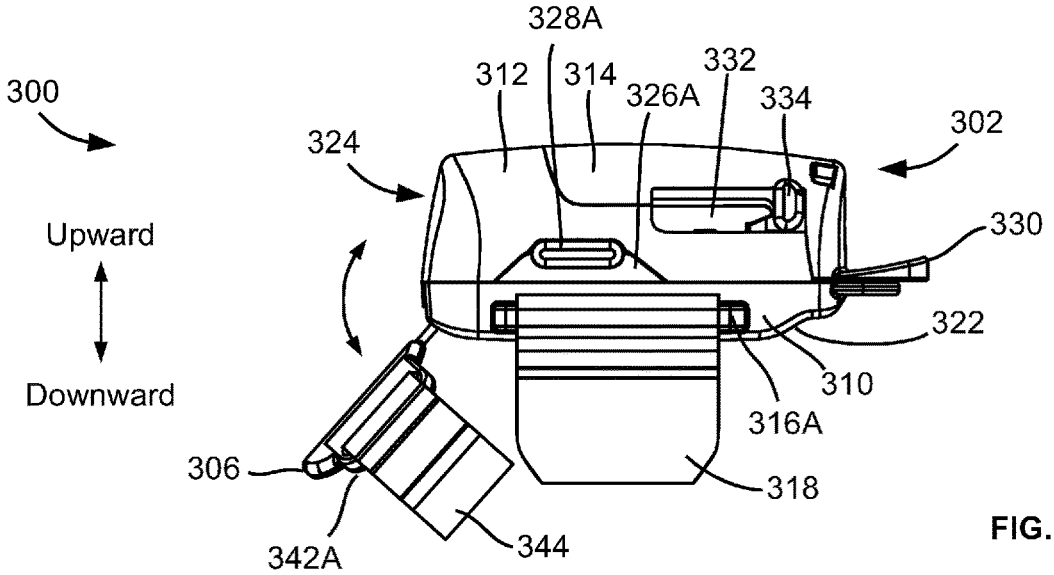
FIG. 16E is a side view of the cutting tool shown in FIG. 16A in a retracted condition.
Figure 16F:
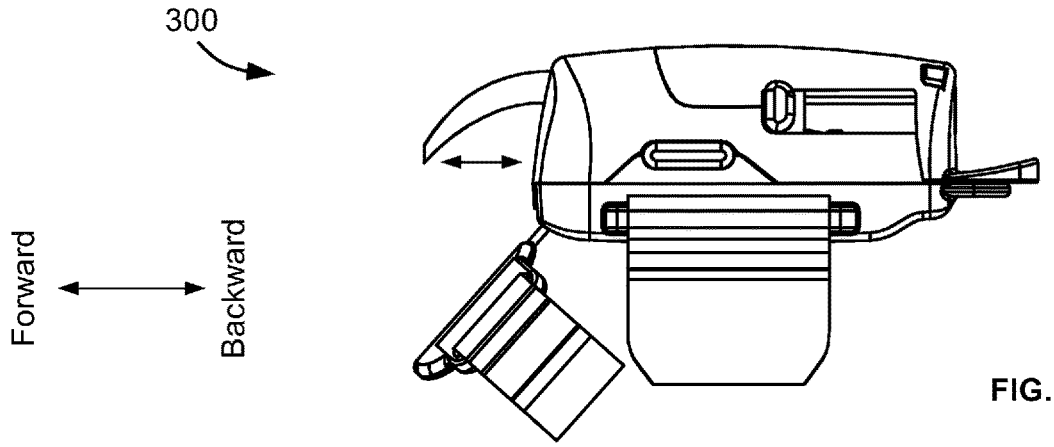
FIG. 16F is a side view of the cutting tool shown in FIG. 16A in the open condition.

As shown in FIG. 16A, the housing 302 also comprises a longitudinal window 332 on a sidewall of the rear upper portion 314. An actuation member 334 of the blade extension/retraction structure extends outwardly from the longitudinal window 332 and is movable along a longitudinal direction for extending and retracting the blade 304 (described in more detail later).

Figure 16G:
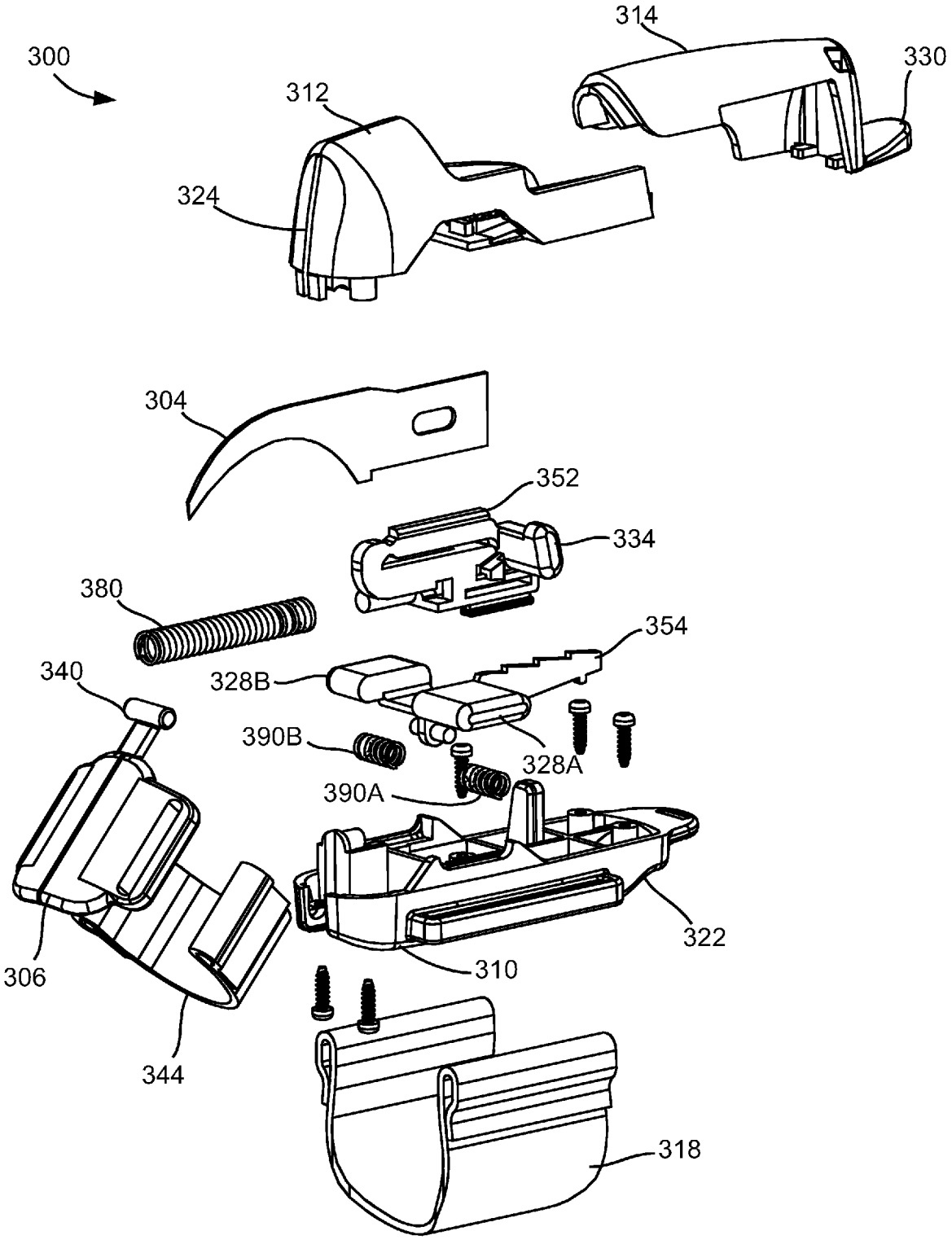
FIG. 16G is an exploded view of the cutting tool shown in FIG. 16A, showing the components thereof.

The cutting tool 300 also comprises a sheath 306 rotatably coupled to a front end of the housing 302 at a pivot 340 (see FIG. 16G). The sheath 306 is laterally slightly curved to adapt to the shape of a finger. The sheath 306 comprises a pair of anchor structures 342A and 342B on opposite sides thereof, respectively, for attaching a strap 344. The straps 318 and 344 (not shown in FIG. 16C) form the mounting structure for attaching the cutting tool 300 onto a user's finger.

Figure 17:
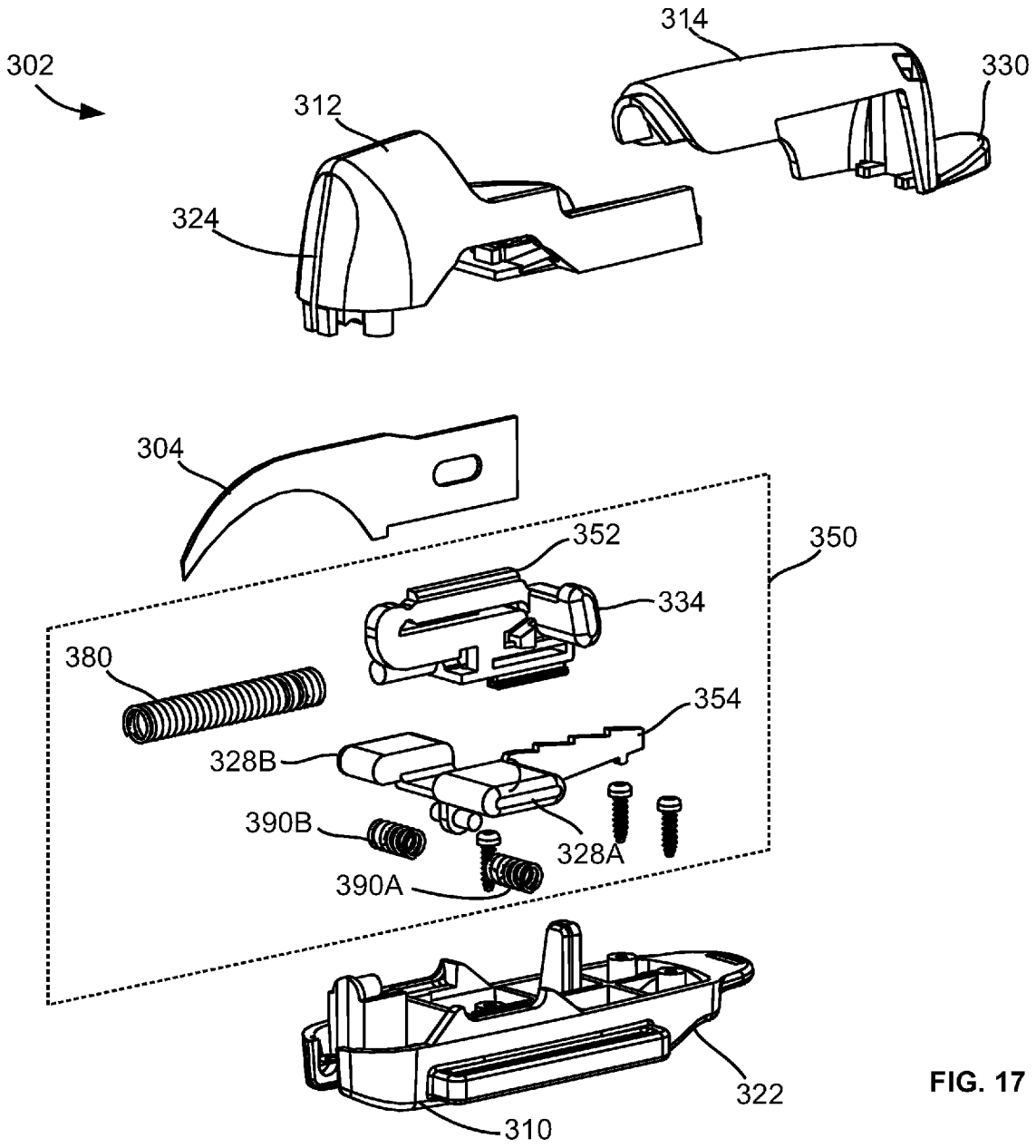
FIG. 17 is an exploded view of the housing of the cutting tool shown in FIG. 16A, showing the components enclosed in the housing.

FIG. 17 shows the housing 302 and the components enclosed therein. For ease of illustration, the front and rear upper portions 312 and 314 are not shown.

As illustrated in FIG. 17, the housing 302 encloses the blade 304 and a blade extension/retraction structure 350 comprising a blade carrier 352, a carrier base 354, a longitudinal, compressible blade-extraction spring 380, and two lateral offset springs 390A and 390B.

Figure 18:
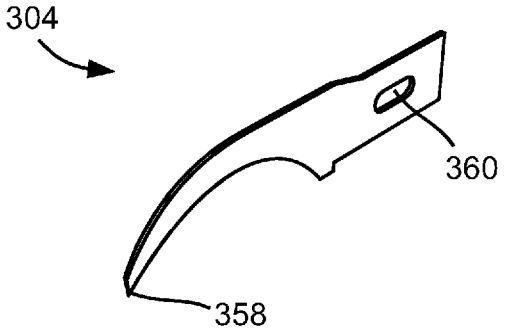
FIG. 18 is a perspective view of a blade of the cutting tool shown in FIG. 16A.

FIG. 18 shows the blade 304. As shown, the blade 304 comprises a tip 358 at a front end thereof and a mounting hole 360 about a rear end thereof. In various embodiments, the blade 304 may be made of a suitable material such as steel, hard plastic, hard polymer, and the like.

Figure 19A:
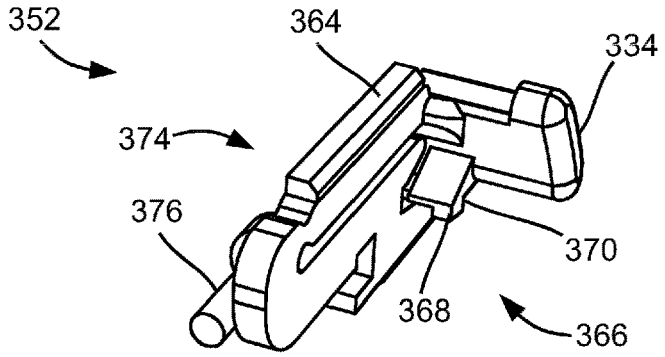
FIG. 19A is a perspective view of a blade carrier of the cutting tool shown in FIG. 16A.
Figure 19B:
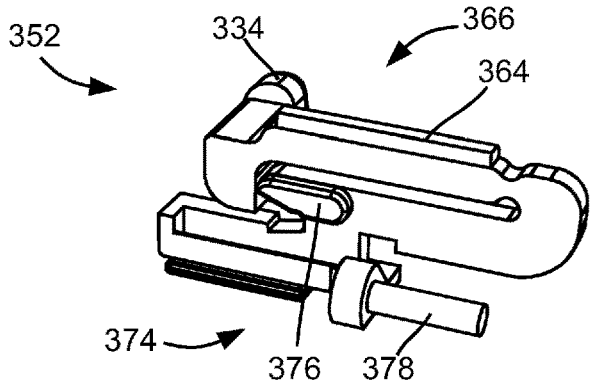
FIG. 19B is a perspective view of the blade carrier shown in FIG. 19A, viewed from another direction.
Figure 19C:
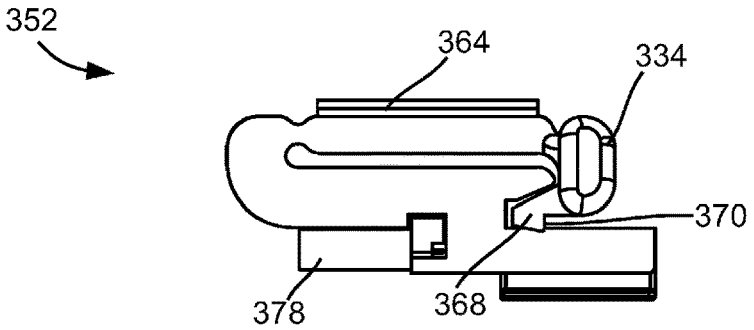
FIG. 19C is a side view of the blade carrier shown in FIG. 19A.

FIGS. 19A to 19C show the blade carrier 352. As shown, the blade carrier 352 comprises a longitudinal body 364. On a first side 366 of the body 364, a post extends laterally from a first side of the body 364 about a rear end thereof thereby forming the actuation member 334. A blade-position delimiter 368 extends forwardly from the actuation member 334. As shown in FIG. 19C, the blade-position delimiter 368 comprises a rearward-facing shoulder 370 for engaging the teeth of the carrier base 354 for positioning the blade 304 (described later).

On a second side 374 opposite to the first side 366, the blade carrier 352 comprises a blade-mounting protrusion 376 protruding laterally from the body 364 for mounting the blade 304. The blade carrier 352 also comprises a forward-facing spring-coupling structure 378 mounted to or integrated to the second side 374 of the body 364 for receiving a longitudinal, compressible blade-extraction spring 380 (see FIGS. 16G and 17).

Figure 20A:
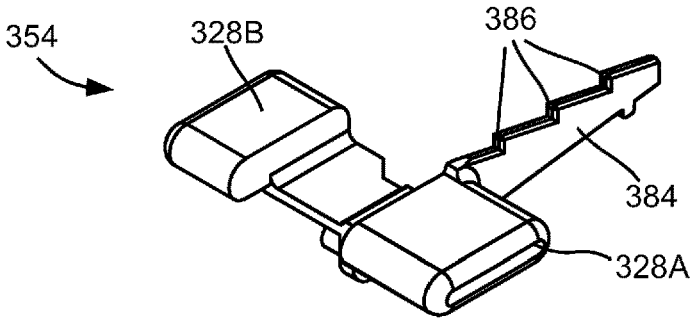
FIG. 20A is a perspective view of a carrier base of the cutting tool shown in FIG. 16A.
Figure 20B:
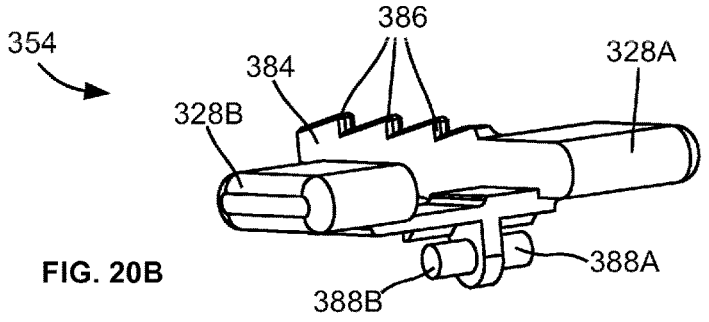
FIG. 20B is a perspective view of a carrier base of the cutting tool shown in FIG. 16A, viewed from another direction.
Figure 20C:
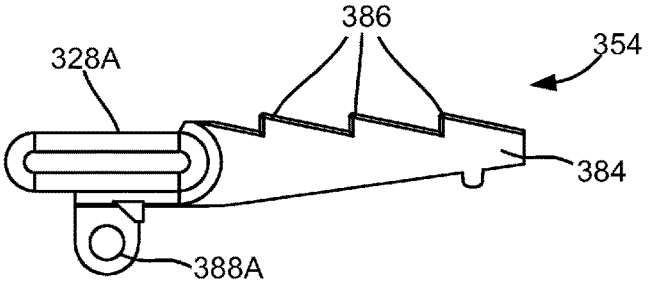
FIG. 20C is a side view of the carrier base shown in FIG. 20A.
Figure 21A:
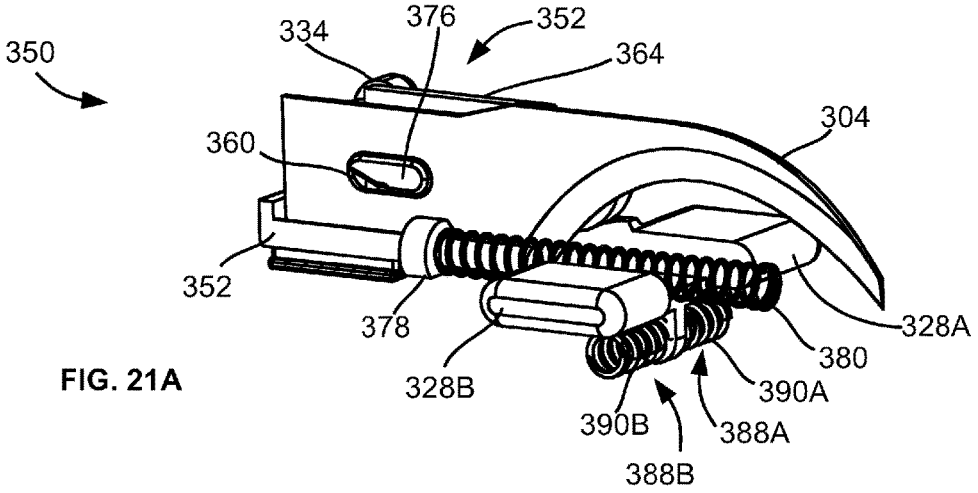
FIG. 21A is a perspective view of an assembled blade extension/retraction structure of the cutting tool shown in FIG. 16A with a blade mounted thereon.
Figure 21B:
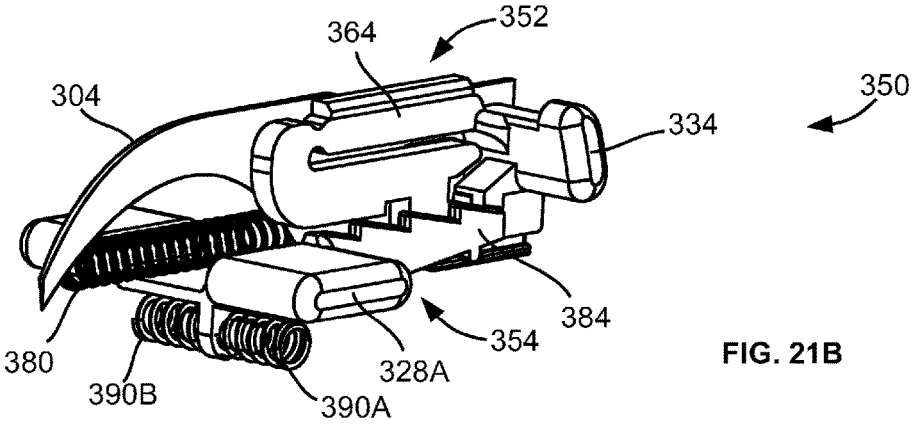
FIG. 21B is a perspective view of the assembled blade extension/retraction structure shown in FIG. 21A, viewed from another direction.
Figure 21C:
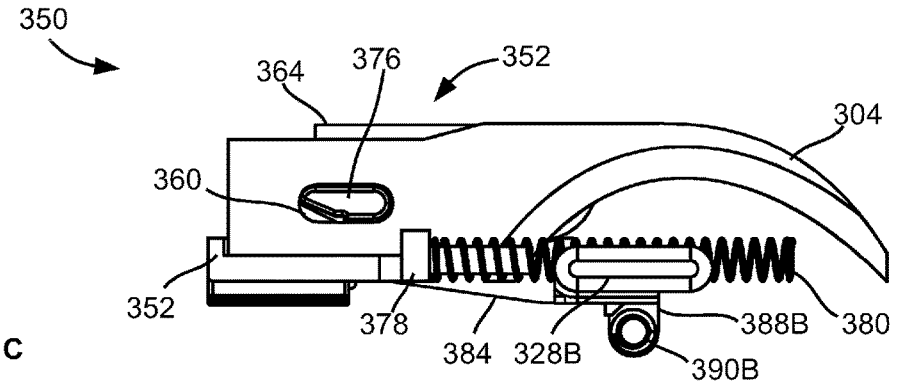
FIG. 21C is a side view of the assembled blade extension/retraction structure shown in FIG. 21A.
Figure 21D:
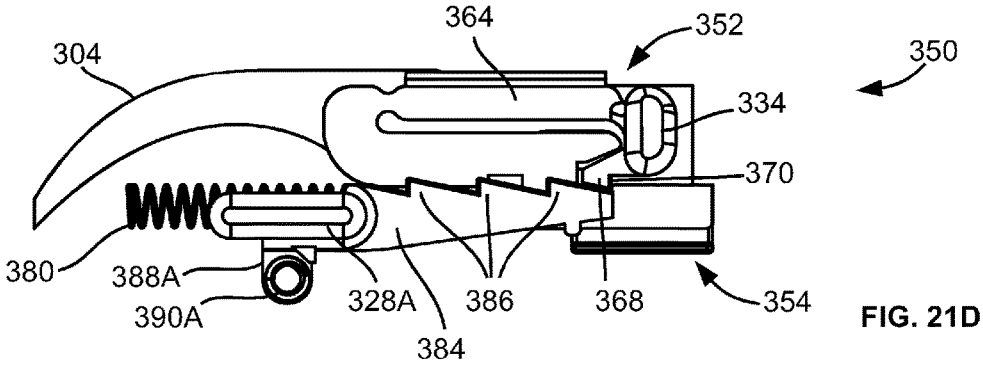
FIG. 21D is another side view of the assembled blade extension/retraction structure shown in FIG. 21A.
Figure 21E:
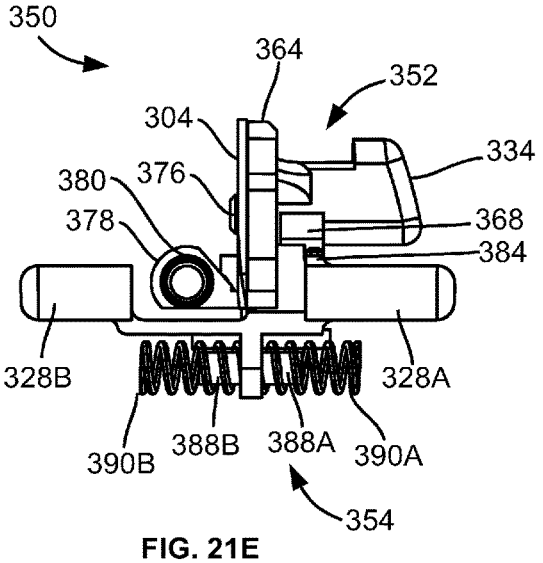
FIG. 21E is a front view of the assembled blade extension/retraction structure shown in FIG. 21A.
Figure 21F:
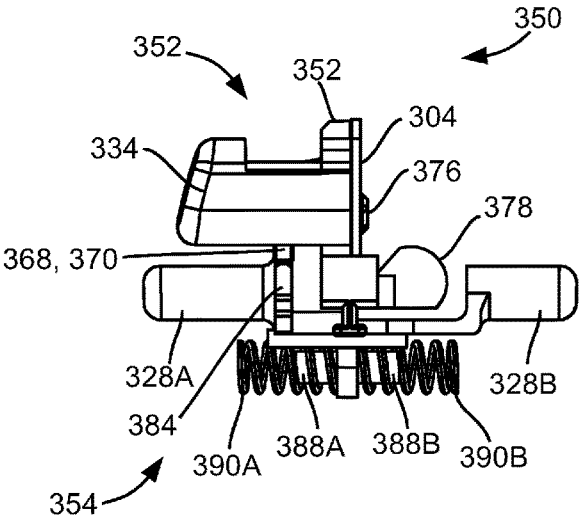
FIG. 21F is a rear view of the assembled blade extension/retraction structure shown in FIG. 21A.
Figure 21G:
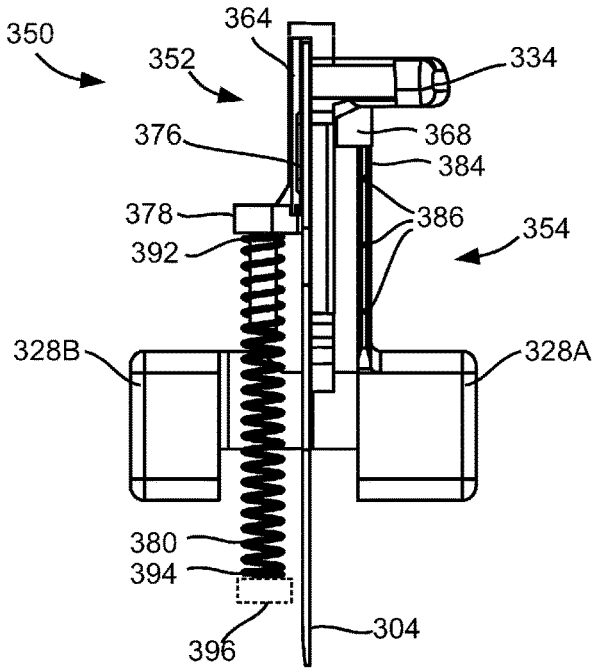
FIG. 21G is a top view of the assembled blade extension/retraction structure shown in FIG. 21A.
Figure 21H:
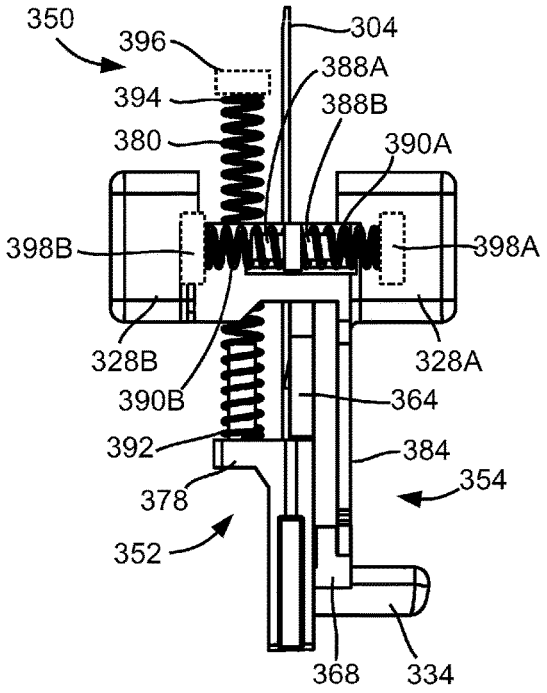
FIG. 21H is a bottom view of the assembled blade extension/retraction structure shown in FIG. 21A.

FIGS. 20A to 20C show the carrier base 354. As shown, the carrier base 354 comprises a longitudinal body 384 having a plurality of upward-facing teeth 386 about a rear portion thereof. Each tooth 386 defines a depth that the blade 304 may extend out of the housing 302. In the example shown in FIGS. 20A to 20C, the carrier base 354 comprises three (3) teeth 386, and therefore, the cutting tool 300 provides three (3) corresponding depths that the blade 304 may extend out of the housing 302.

A pair of posts extends from a front end of the body 384 along opposite lateral directions thereby forming the release buttons 328A and 328B. The carrier base 354 also comprises a pair of spring-coupling structures 388A and 388B under the body 384 that are mounted thereto or integrated thereto about a front end thereof. The pair of spring-coupling structures 388A and 388B extend along opposite lateral directions and receive a pair of lateral offset springs 390A and 390B (see FIGS. 16G and 17), respectively.

FIGS. 21A to 21H show an assembled blade extension/retraction structure 350 with a blade 304 mounted thereon. As shown, after assembling, the blade 304 is attached to the blade carrier 352 by fitting the blade-mounting protrusion 376 of the blade carrier 352 into the blade-mounting hole 360 of the blade 304. The blade carrier 352 is positioned on the carrier base 354 with the blade-position delimiter 368 of the blade carrier 352 longitudinally aligned with the body 384 of the carrier base 354 (see FIG. 21F) such that when the blade carrier 352 and the blade 304 move forward or backward, the blade-position delimiter 368 of the blade carrier 352 can engage one of the teeth 386 of the carrier base 354 to position the blade 304.

As shown in FIGS. 21G, 21H, 22A and 22B, the longitudinal, compressible blade-extraction spring 380 is positioned on the spring-coupling structure 378 at one end 392 thereof. The other end 394 of the blade-extraction spring 380 is delimited by a stopper 396 of the bottom wall 310 of the housing 302. Similarly, each of the two lateral offset springs 390A and 390B is positioned on the respective mounting structure 388A, 388B at one end thereof, and is delimited at the other end thereof by a respective stopper 398A, 398B of the bottom wall 310 of the housing 302.

Figure 22A:
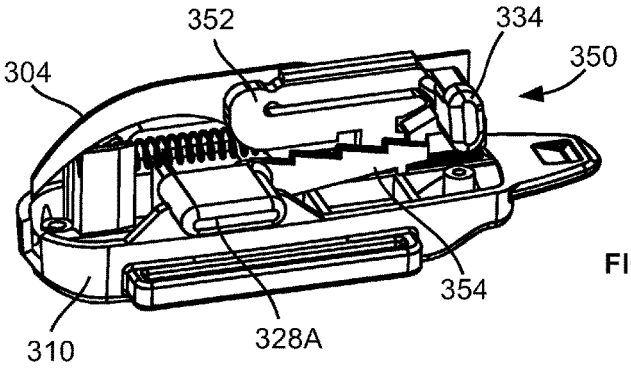
FIGS. 22A and 22B are perspective views of the assembled blade extension/retraction structure shown in FIG. 21A installed on a bottom wall of the housing of the cutting tool shown in FIG. 16A.
Figure 22B:
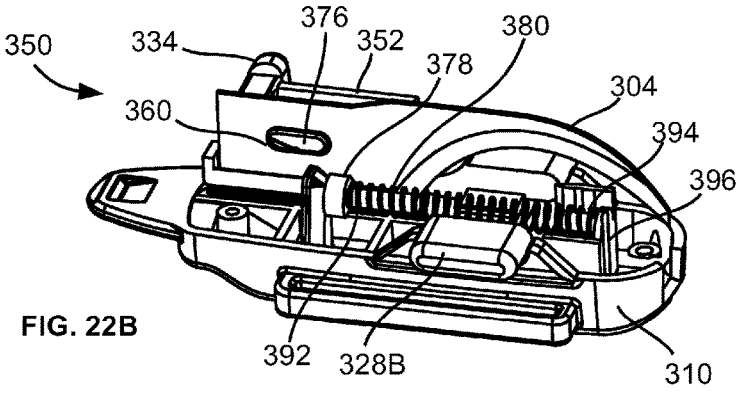

As shown in FIGS. 22A and 22B, the assembled blade extension/retraction structure 350 and a blade 304 are movably suspended both longitudinally and laterally in the housing 302 (FIGS. 22A and 22B only showing the bottom wall 310 thereof for ease of illustration) by the blade-extraction spring 380 and the pair of lateral offset springs 390A and 390B. Without any external force applied to the release buttons 328A and 328B, the two lateral offset springs 390A and 390B maintain the blade-position delimiter 368 of the blade carrier 352 longitudinally aligned with the body 384 of the carrier base 354.

Figure 23A:
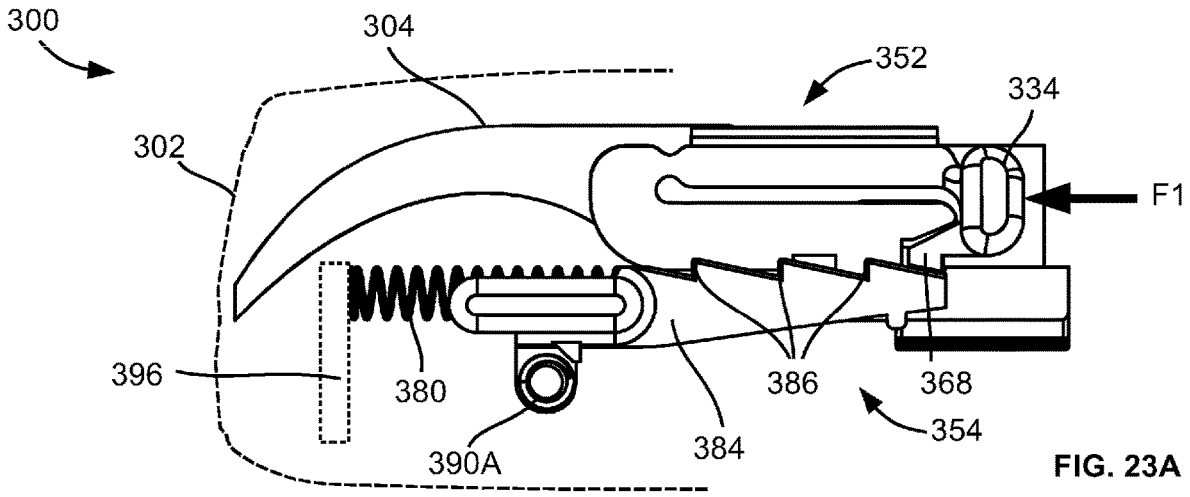
FIG. 23A is a schematic side view of a portion of the cutting tool shown in FIG. 16A in a retracted condition.
Figure 23B:
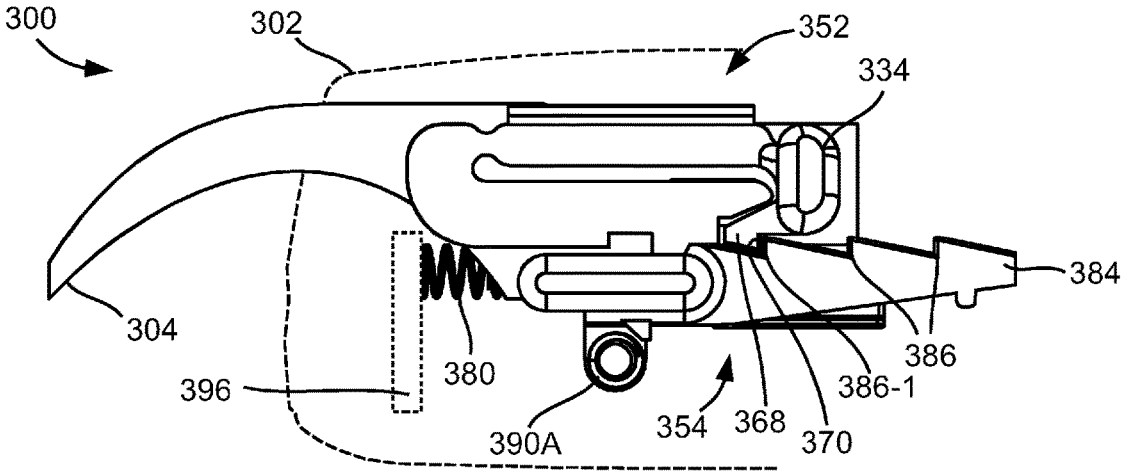
FIG. 23B is a schematic side view of a portion of the cutting tool shown in FIG. 16A in an open condition.

FIG. 23A shows a portion of the cutting tool 300 in a retracted condition where the blade 304 is retracted in the housing 302. To extend the blade, a user (not shown) applies a generally forward force F1 onto the actuation member 334 with sufficient strength to bias the blade-extraction spring 380, and move the blade carrier 352 and blade 304 forward to extend the blade 304 out of the housing 302 as shown in FIG. 23B. When the rearward-facing shoulder 370 engages a tooth, for example the tooth 386-1, the blade 304 is delimited at a respectively predefined position, and would not automatically retract into the housing 302 when the forward force F1 is removed. The cutting tool 300 is now in a blade-extended configuration (which may be the open condition if the sheath 306 is rotated away from the blade 304, or may be the closed condition if the sheath 306 is in proximity with the blade 304).

Figure 23C:
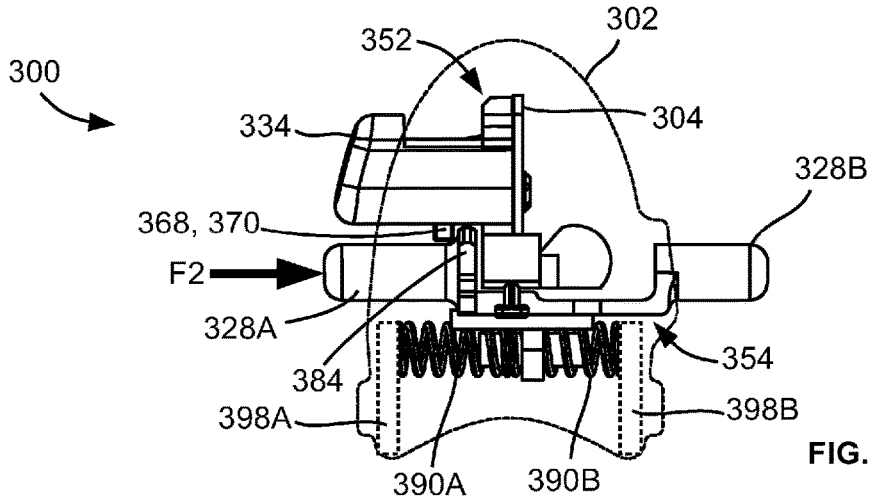
FIG. 23C is a schematic rear view of a portion of the cutting tool shown in FIG. 16A in the open condition.

Referring to FIG. 23C, to retract the blade 304, the user (not shown) applies a generally laterally inward force F2 onto the release button 328A with sufficient strength to bias the lateral offset spring 390B and laterally shift the carrier base 354, such that the blade-position delimiter 368 of the blade carrier 352 is misaligned with the body 384 of the carrier base 354. Consequently, the rearward-facing shoulder 370 is disengaged with the tooth 386-1 (not shown in FIG. 23C). The biased blade-extraction spring 380 then moves the blade carrier 352 and the blade 304 rearwardly to retract the blade 304 into the housing 302. The cutting tool 300 is now in a retracted condition. When the lateral force F2 is removed, the biased lateral offset spring 390B shifts the body 384 of the carrier base 354 back to the position longitudinally aligned with the blade-position delimiter 368 of the blade carrier 352.

Of course, one may alternatively apply a generally laterally inward force onto the release button 328B with sufficient strength to bias the lateral offset spring 390A to retract the blade 304 into the housing 302.

Figure 24A:
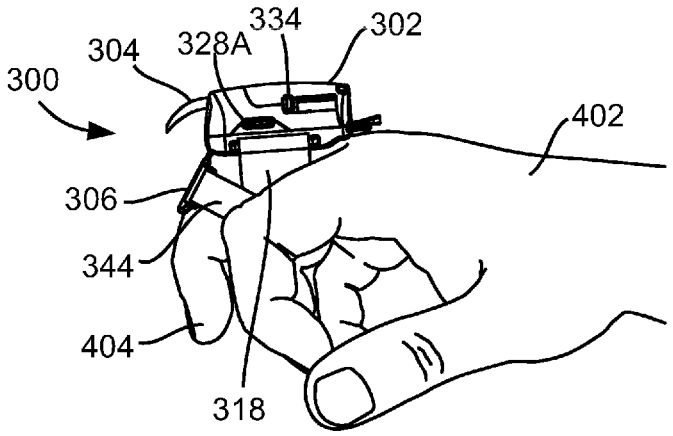
FIGS. 24A and 24B show two examples of wearing and using the cutting tool shown in FIG. 16A.
Figure 24B:
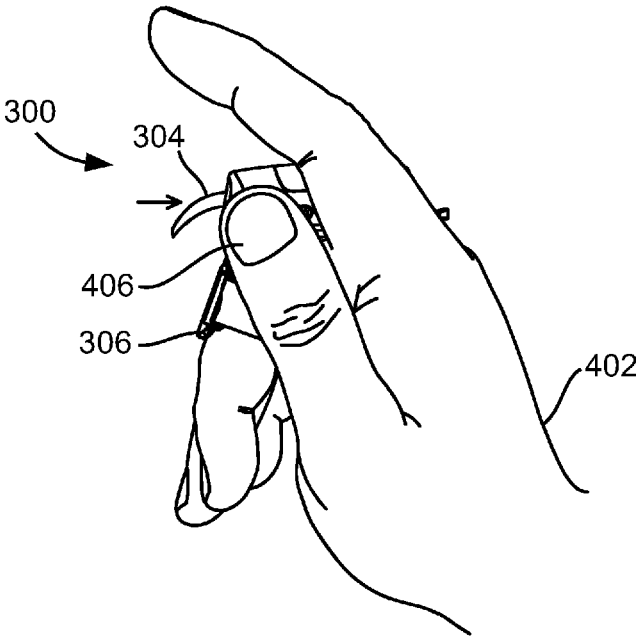

FIGS. 24A and 24B show two examples of a user wearing and using the cutting tool 300. As shown, a cutting tool 300 is attached to the user's middle finger 404 of his/her hand 402 via the mounting structure thereof, which includes the strap 318 of the housing 302 and the strap 344 of the sheath 306. The actuation member 334 has been pushed forward to extend the blade 304 out of the housing 302. In FIG. 24A, the user bends the middle finger 404 to expose the blade 304 for using such as cutting and opening taped boxes.

In FIG. 24B, the user uses the thumb 406 to push the release button 328A (not shown in FIG. 24B) inwardly to retract the blade 304 into the housing 302.

With above description, those skilled in the art will appreciate that a user may attach or fit the cutting tool 300 to their finger using the straps 318 and 344. The use may attach the cutting tool 300 to a bare finger, a finger with a comfort sleeve thereon, or a finger while wearing a glove.

The user may manually extend the blade 304 out of the housing 302 to a desired depth setting. The user can then bend the finger to use the tool such as cutting a taped box. When the user has completed the cutting work and would like to preform another work such as empty the contents in the box, the user may push the release button 328A or 328B to retract the blade 304 into the housing 302, or alternatively simply stretch the finger to shade the blade using the sheath.

In these embodiments, the housing 302 and the blade extension/retraction structure 350 provide enhanced safety by allowing the user to fully retract the blade 304 into the housing 302 to prevent injury. The two release buttons 328A and 328B on opposite sidewalls provide the advantage of convenient, one-hand operation of blade retraction for both left-hand wearing and right-hand wearing of the cutting tool 300. The cutting tool 300 also provides increased efficiency by freeing the user's hand for other tasks as the user does not need to hold the cutting tool 300 for work. Moreover, the user also avoids the burden of dropping, losing and/or searching for the cutting tool 300.

In some alternative embodiments, the cutting tool 300 may only comprise one release button 328A or 328B on a sidewall thereof.

Figure 25:
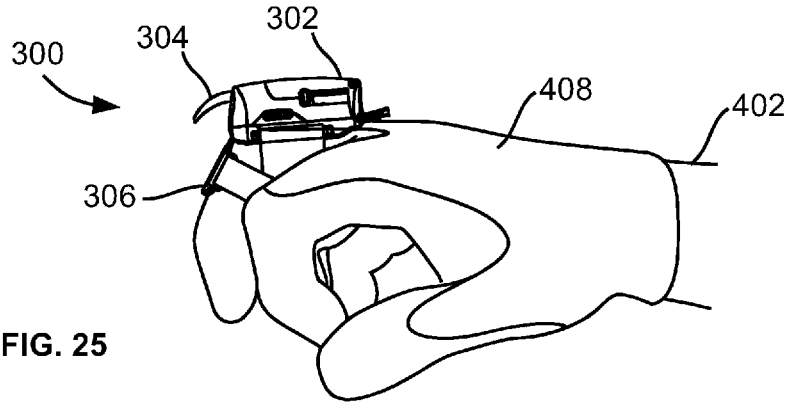
FIG. 25 is a side view of a utility instrument in the form of a wearable cutting tool in an open condition, according to some alternative embodiments of this disclosure, wherein the cutting tool comprises a mounting structure in the form of a glove.

In some alternative embodiments as shown in FIG. 25, the mounting structure of cutting tool 300 may be in the form of a glove 408 wherein the housing 302 and the sheath 306 are coupled to a finger of the glove 408.

In some alternative embodiments, the mounting structure of the cutting tool 300 may comprise a sleeve for comfort and at least one strap for coupling the tool 300 to a finger.

Figure 26:
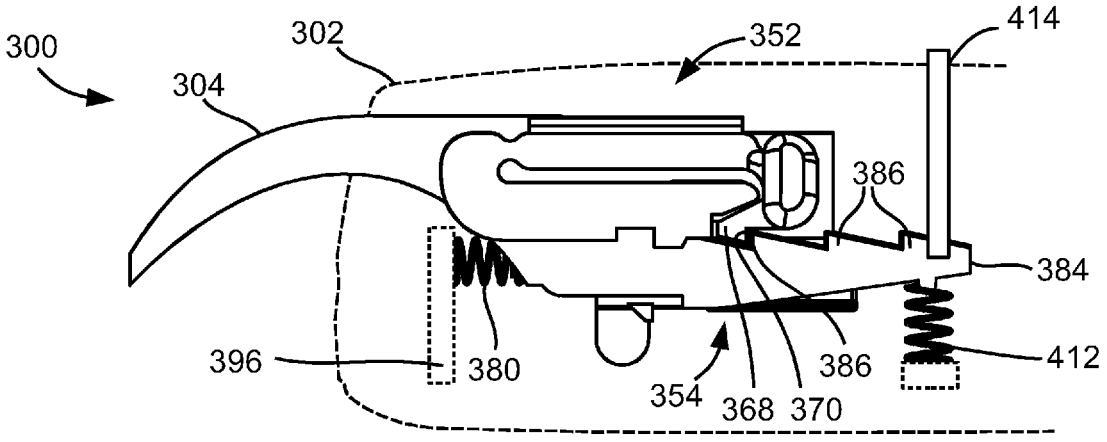
FIG. 26 is a schematic side view of a portion of a utility instrument in the form of a wearable cutting tool in an open condition, according to some alternative embodiments of this disclosure.

In some alternative embodiments, the release button may be located on other suitable positions of the housing 302. For example, FIG. 26 shows a cutting tool 300 in an alternative embodiment. In this embodiment, the cutting tool 300 does not comprise any later offset spring 390A or 390B. Rather, a generally upright spring 412 supports the carrier base 354. A push button 414 extends from the body 384 of the carrier base 354 upwardly out of the housing 302. A user may press the push button 414 downwardly to disengage the blade-position delimiter 368 from the tooth 386 of the carrier base 354 to retract the blade 304 into the housing 302.

Figure 27A:
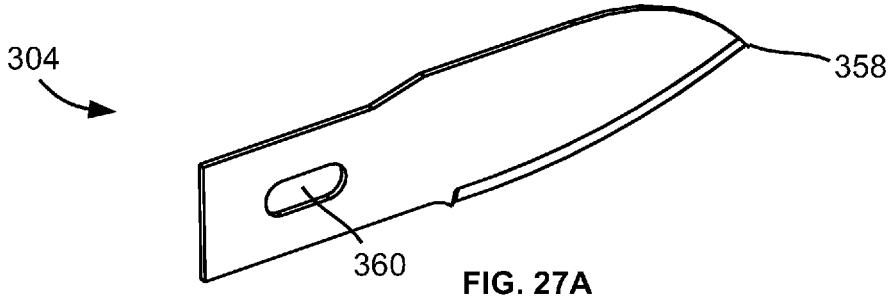
FIGS. 27A and 27B are perspective views of blades, according to some alternative embodiments of this disclosure.
Figure 27B:
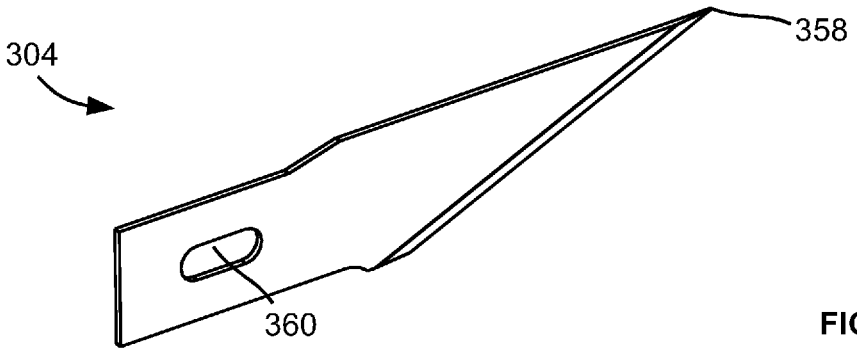
Figure 28A:
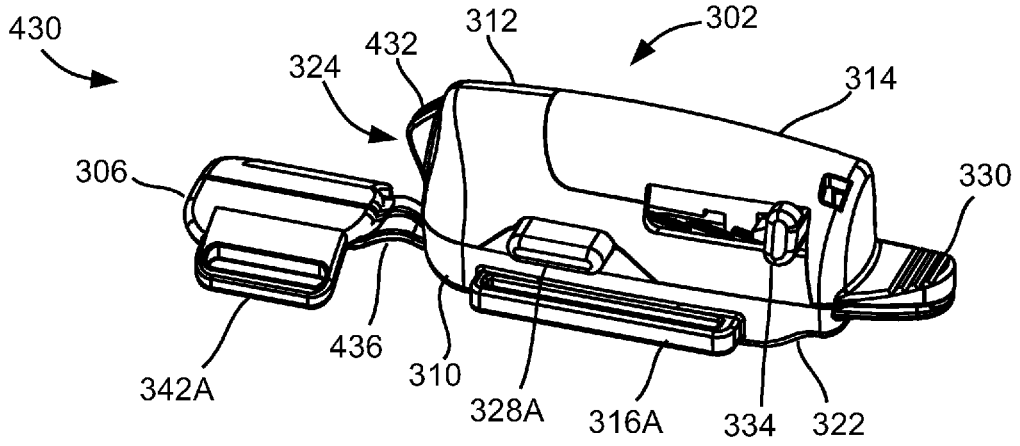
FIG. 28A is a perspective view of a utility instrument in the form of a wearable cutting tool in a retracted condition, according to some alternative embodiments of this disclosure.
Figure 28B:
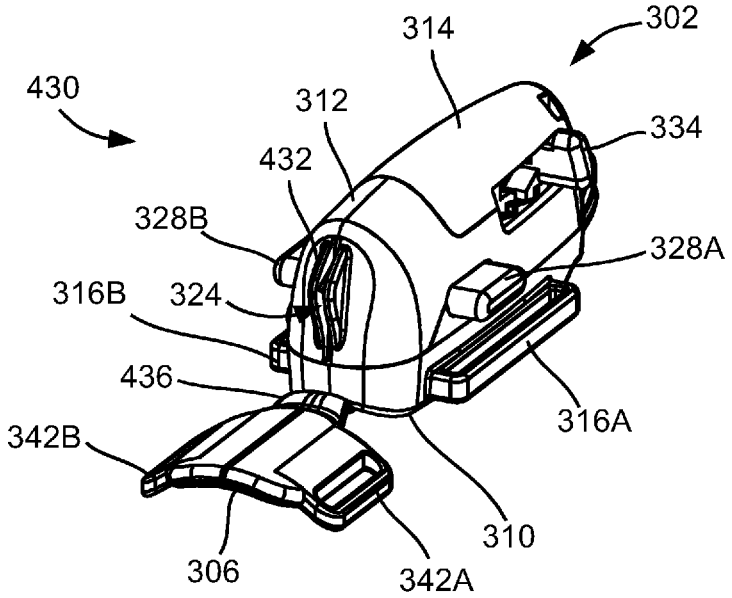
FIGS. 28B and 28C are perspective views of the cutting tool shown in FIG. 28A in the retracted condition, viewed from other directions.
Figure 28C:
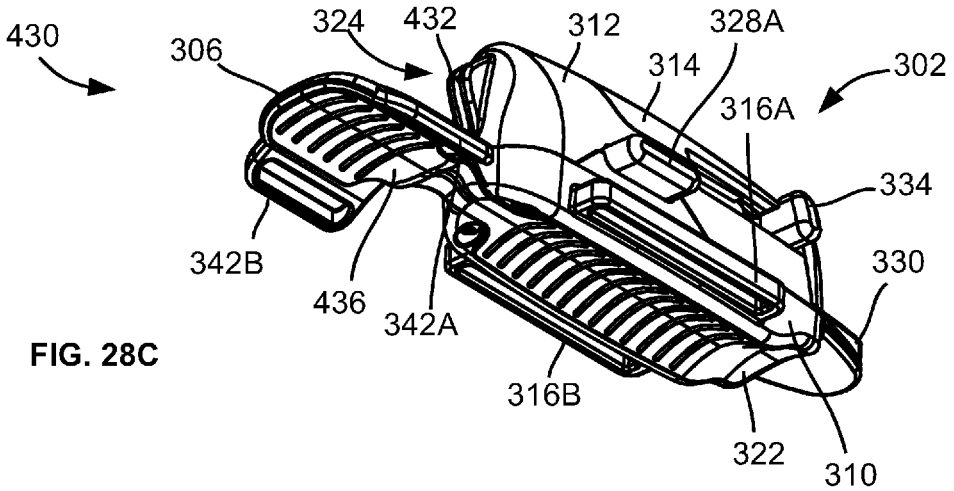
Figure 28D:
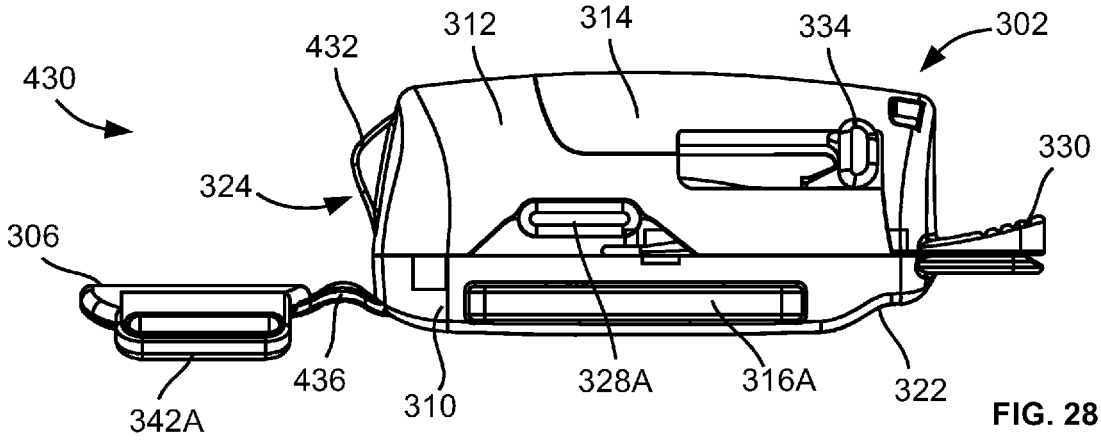
FIG. 28D is a side view of the cutting tool shown in FIG. 28A in a retracted condition.
Figure 28E:
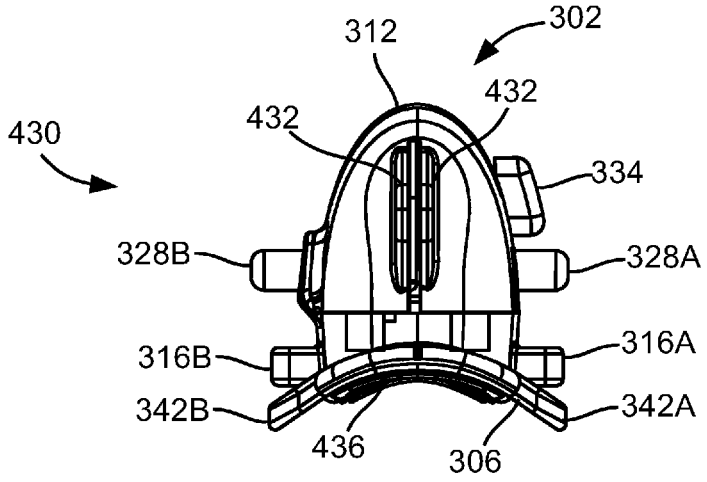
FIG. 28E is a front view of the cutting tool shown in FIG. 28A in a retracted condition.
Figure 28F:
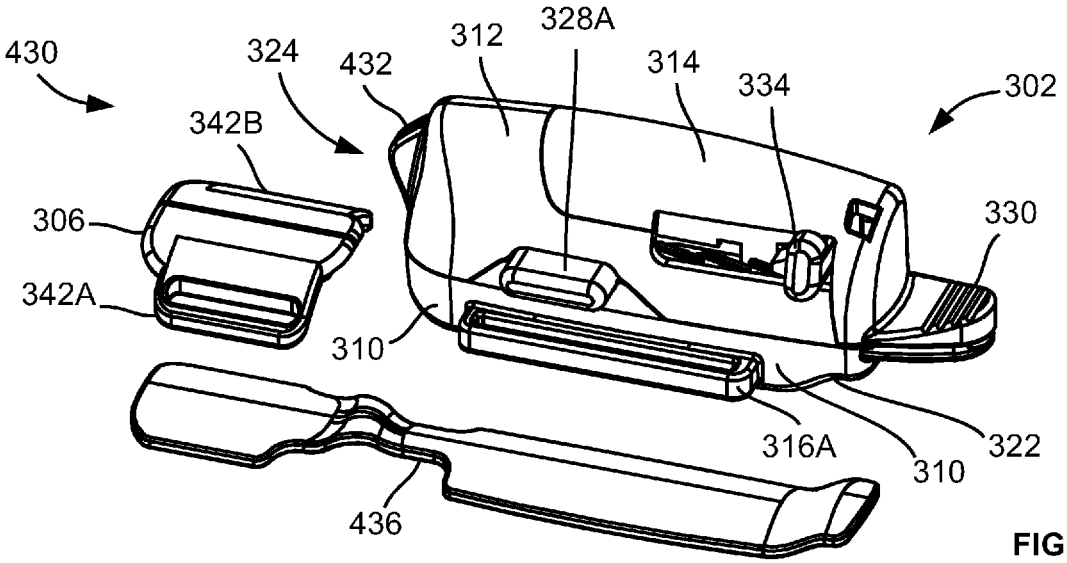
FIG. 28F is a partially exploded view of the cutting tool shown in FIG. 28A in a retracted condition.

Those skilled in the art appreciate that the blade 304 may be other suitable shapes in some alternative embodiments. FIGS. 27A and 27B show two examples of blades 304.

In some alternative embodiments, the cutting tool 300 may only comprise one strap coupled to the housing 302. In these embodiments, the sheath 306 may be rotated away from the front opening 324 of the housing 302 by gravity.

FIGS. 28A to 28F show a cutting tool 430 in some alternative embodiments. The cutting tool 430 is similar to the cutting tool 300. However, in these embodiments, the housing 302 of the cutting tool 430 further comprises a pair of fences 432 about the front opening 324 thereby allowing the use of a longer blade 304. Moreover, in these embodiments, the sheath 306 is not coupled to the housing via a pivot. Rather, the cutting tool 430 comprises a flexible band 436 coupled to both the housing 302 and the sheath 306 using suitable fastening components such as rivets, screws, glue/adhesive, nails, and the like. A distance is maintained between the housing 302 and the sheath 306 for adapting to a user's knuckle when in use. The flexible band 436 may be made of any suitable flexible material such as flexible polymer, flexible plastic, fabric, and the like.

Figure 29A:
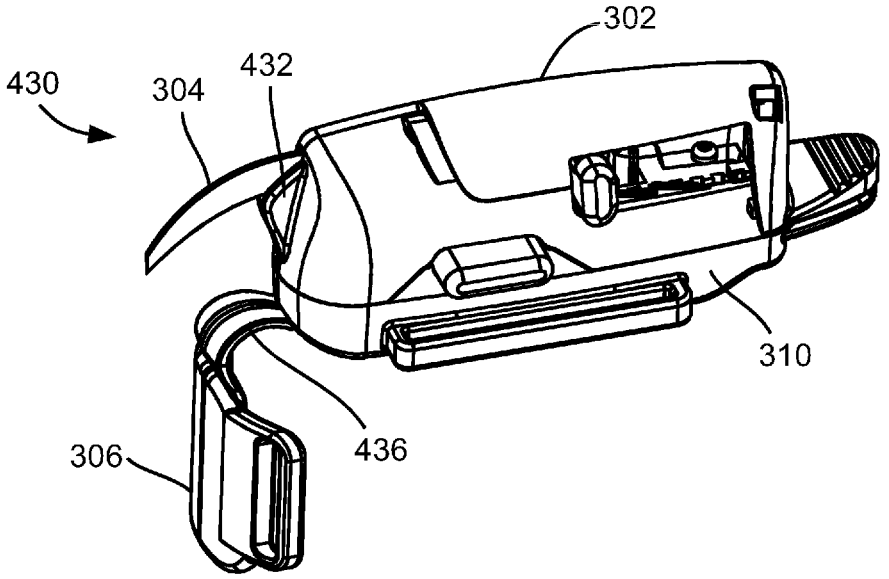
FIG. 29A is a perspective view of the cutting tool shown in FIG. 28A in an open condition.
Figure 29B:
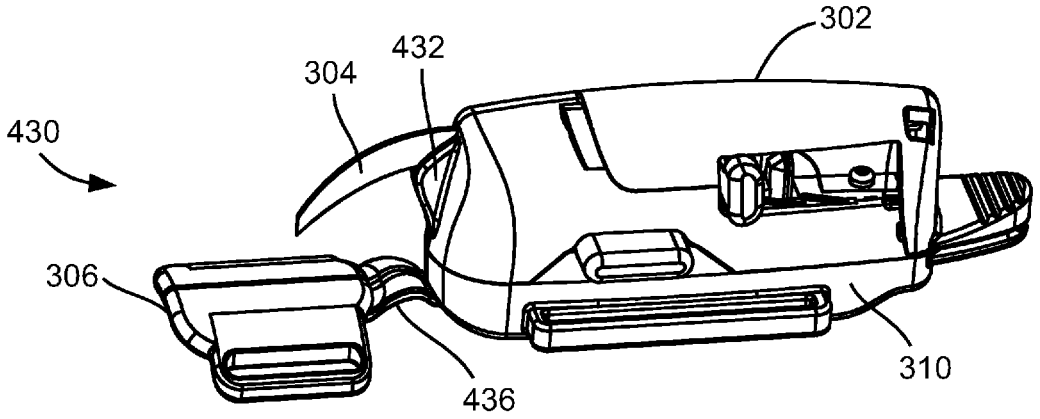
FIG. 29B is a perspective view of the cutting tool shown in FIG. 28A in a closed condition.
Figure 29C:
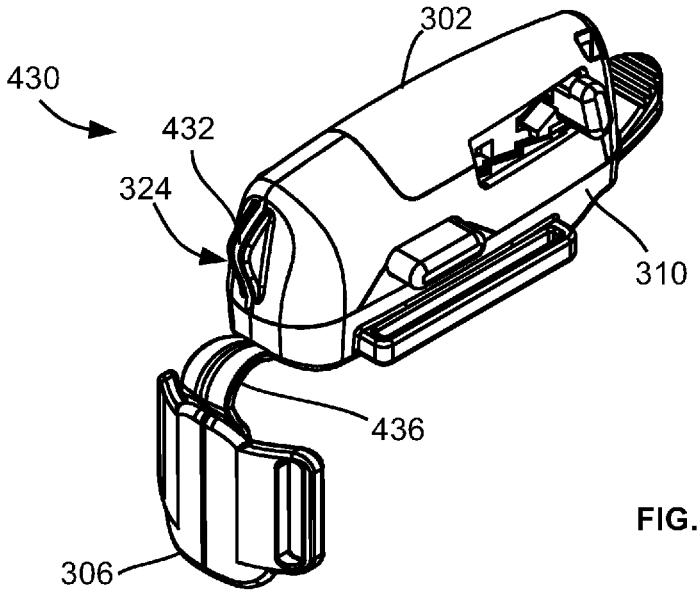
FIG. 29C is a perspective view of the cutting tool shown in FIG. 28A in the retracted condition.
Figure 30A:
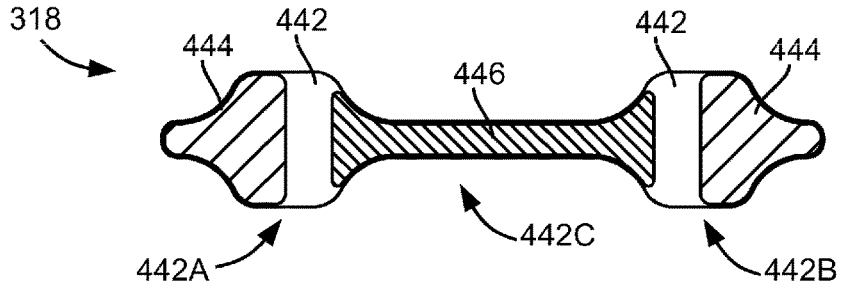
FIG. 30A is a plan view of a strap of the cutting tool, according to some alternative embodiments of this disclosure.
Figure 30B:
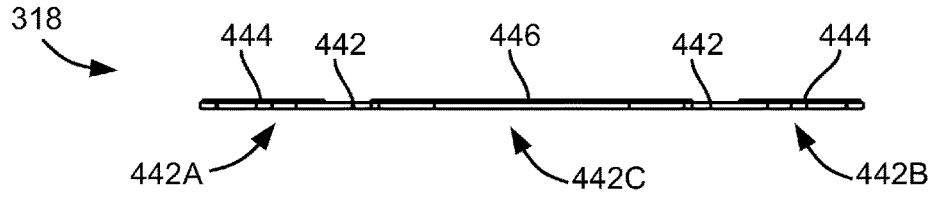
FIG. 30B is a side view of the strap shown in FIG. 30A.
Figure 30C:
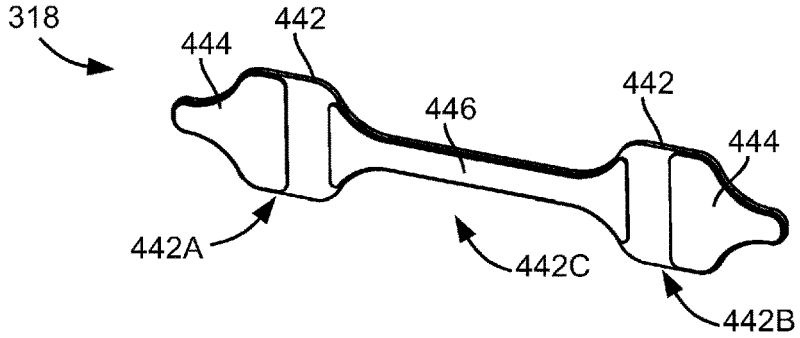
FIG. 30C is a perspective view of the strap shown in FIG. 30A.
Figure 30D:
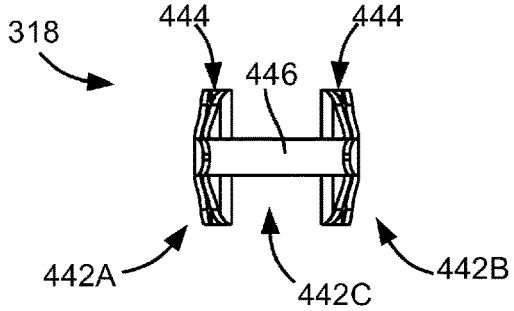
FIG. 30D is a bottom view of the strap shown in FIG. 30A coupled to an anchor structure (not shown)
Figure 30E:
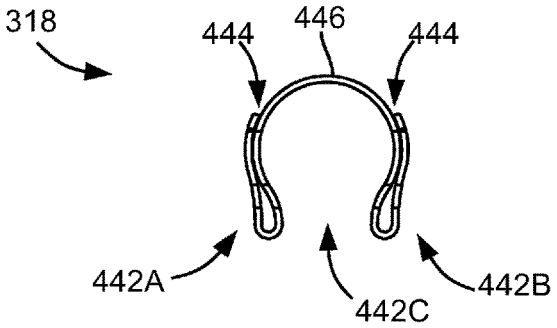
FIG. 30E is a side view of the strap shown in FIG. 30D.
Figure 30F:
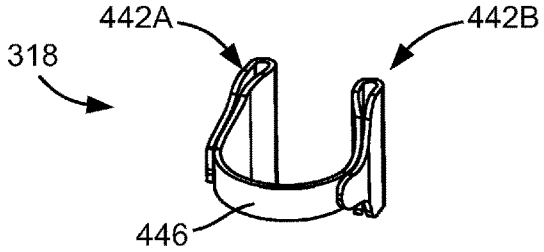
FIG. 30F is a perspective view of the strap shown in FIG. 30D.
Figure 31A:
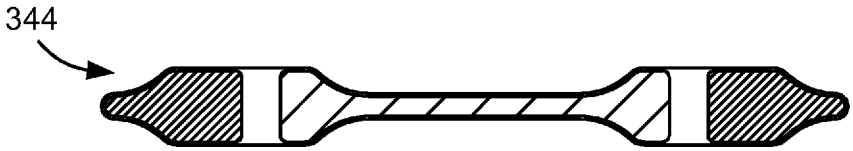
FIG. 31A is a plan view of another strap of the cutting tool, according to some alternative embodiments of this disclosure.
Figure 31B:
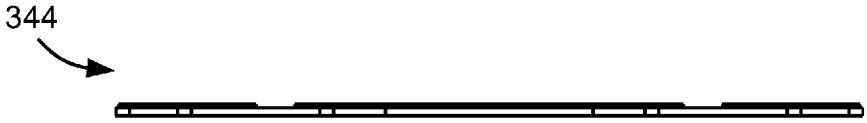
FIG. 31B is a side view of the strap shown in FIG. 31A.
Figure 31C:
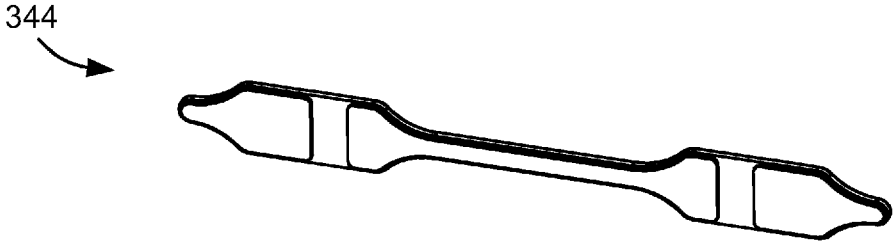
FIG. 31C is a perspective view of the strap shown in FIG. 31A.
Figure 31D:
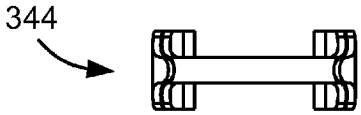
FIG. 31D is a bottom view of the strap shown in FIG. 31A coupled to an anchor structure (not shown)
Figure 31E:
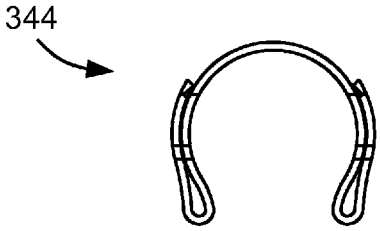
FIG. 31E is a side view of the strap shown in FIG. 31D.
Figure 31F:
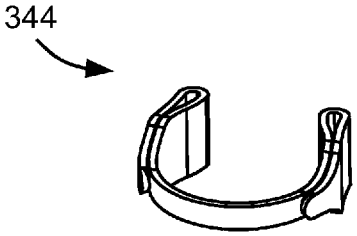
FIG. 31F is a perspective view of the strap shown in FIG. 31D.

FIGS. 29A to 29C show different conditions of the cutting tool 430. FIG. 29A show the cutting tool 430 in an open condition where the blade 304 is extended out of the housing 302 and the sheath 306 is bent downwardly away from the front opening 324 of the housing 302 to expose the extended blade 304. FIG. 29B shows the cutting tool 430 in a closed condition where the blade 304 is extended out of the housing 302, and the sheath 306 is straightened to shade the extended blade 304. FIG. 29C shows the cutting tool 430 in a retracted condition where the blade 304 is fully retracted into the housing 302. In the retraced condition, the sheath 306 may be bent or straightened.

In some alternative embodiments, the straps may be coupled to the flexible band 436 for tying the housing 302 and the sheath 306 onto a user's finger.

In the embodiments shown in FIG. 16G, each of the straps 318 and 344 are of a constant width. FIGS. 30A to 30F show the strap 318 in some alternative embodiments. The strap 318 in these embodiments comprises a base 442 made of a flexible and/or elastic material. The base 442 comprises a narrow middle portion 442C and two wide end portions 442A and 442B.

A touch fastener such as a Velcro hook and loop faster is coupled to the base 442 using suitable fastening methods such as stitching, gluing, nailing and the like. In particular, a pair of touch fastener hook components 444 are coupled to the ends of the base 442, respectively, and a touch fastener loop component 446 is coupled to the middle portion of the base 442. In use, the two ends 442A and 442B wrap around the anchor structures 316*a* and 316B, respectively, of the housing 302, and the touch fastener hook components 444 engage the touch fastener loop component 446 to fasten the strap 318 to the housing 302.

FIGS. 31A to 31F show the strap 344 in some alternative embodiments. As can be seen the strap 344 in these embodiments is similar to the strap 318 shown in FIGS. 30A to 30F except that the strap 344 has a narrower width.

Figure 32A:
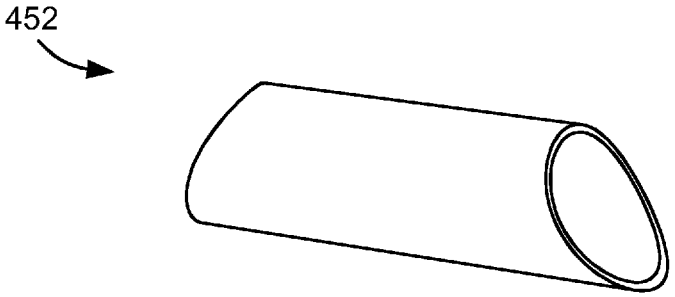
FIG. 32A is a perspective view of a comfort sleeve of the cutting tool, according to some alternative embodiments of this disclosure.
Figure 32B:
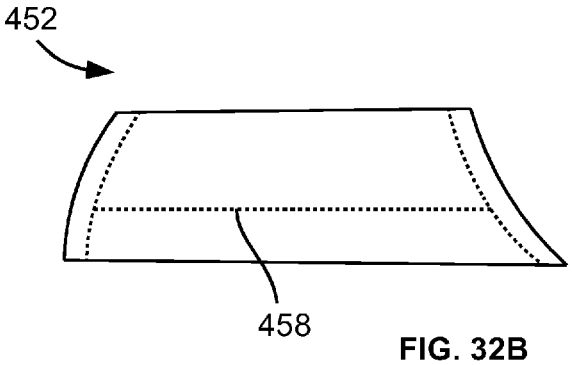
FIG. 32B is a side view of the comfort sleeve shown in FIG. 32A.
Figure 32C:
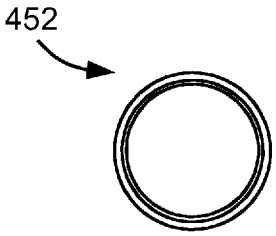
FIG. 32C is a front view of the comfort sleeve shown in FIG. 32A.
Figure 32D:
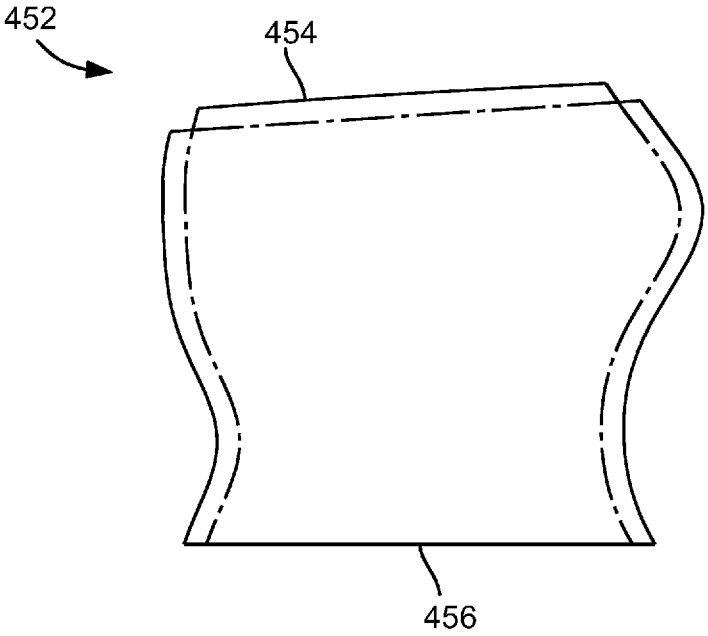
FIG. 32D is a flattened plane view of the comfort sleeve shown in FIG. 32A.

FIGS. 32A to 32D show a comfort sleeve 452 that may be used with straps 318 and 344 to form the mounting structure of the cutting tool. As shown, the comfort sleeve 452 is made of a piece of soft material such as a piece of fabric as shown in FIG. 32D, and stitched or otherwise coupled along the two sides 454 and 456 thereof to form a sleeve. FIG. 32B shows the stitching line 458.

Although embodiments have been described above with reference to the accompanying drawings, those of skill in the art will appreciate that variations and modifications may be made without departing from the scope thereof as defined by the appended claims.

What is claimed is:

1. A method of cutting an object comprising:

attaching a housing onto a finger about a knuckle at a proximal side thereof, the housing receiving therein a blade longitudinally movable for extending out of the housing and retracting thereinto, the blade having a cutting edge facing to a bottom wall of the housing;

attaching a protection component onto the finger about the knuckle at a distal side thereof;

extending the blade out of the housing;

bending the finger about the knuckle to rotate the protection component away from the blade; and moving the hand to cut the object using the blade.

2. The method of claim 1 further comprising:

straightening the distal side of the finger about the knuckle to rotate the protection component towards the blade for shading the blade.

3. The method of claim 1 further comprising:

retracting the blade into the housing by pressing a release button that extends out of the housing from a sidewall thereof.

* * * * *